US006991124B1

(12) United States Patent
Palley et al.

(10) Patent No.: US 6,991,124 B1
(45) Date of Patent: Jan. 31, 2006

(54) BLAST RESISTANT AND BLAST DIRECTING CONTAINERS AND METHODS OF MAKING

(75) Inventors: Igor Palley, Madison, NJ (US); Gary Allan Harpell, Morristown, NJ (US); Max Wilhelm Gerlach, Hackettstown, NJ (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 08/533,589

(22) Filed: Sep. 25, 1995

(51) Int. Cl.
*B65D 6/26* (2006.01)
*B65D 88/14* (2006.01)
*B65D 88/24* (2006.01)

(52) U.S. Cl. ..... 220/1.5; 220/8; 220/9.4; 220/560.01; 220/652

(58) Field of Classification Search ..... 220/560.01, 220/1.5, 8, 652, 9.4; 229/23 AB, 23 R, 23 BT; 109/1 R, 1 S, 49.5, 76, 80, 82, 83, 84
See application file for complete search history.

(56) References Cited

U.S. PATENT DOCUMENTS

| | | | | |
|---|---|---|---|---|
| 674,009 | A | * 5/1901 | Lewis | 229/23 R |
| 2,475,441 | A | 7/1949 | Abbott | |
| 2,946,473 | A | 7/1960 | Moseley | |
| 3,067,925 | A | 12/1962 | Gilliam | |
| 3,093,259 | A | 6/1963 | Morrison | |
| 3,445,052 | A | 5/1969 | Lewallen | |
| 3,611,512 | A | 10/1971 | Sholl | |
| 3,786,956 | A | 1/1974 | Tabor | |
| 3,822,807 | A | 7/1974 | MacDonald | |
| 3,969,812 | A | 7/1976 | Beck | |
| 4,027,601 | A | 6/1977 | Hickerson | |
| 4,046,277 | A | 9/1977 | Morrison | |
| 4,055,247 | A | 10/1977 | Benedick et al. | |
| 4,216,803 | A | * 8/1980 | Hall | 220/900 X |
| 4,266,670 | A | 5/1981 | Mykleby | |
| 4,290,468 | A | * 9/1981 | Rosenbloom, Jr. et al. | 220/9.1 |
| 4,432,285 | A | 2/1984 | Boyars et al. | |
| 4,623,574 | A | * 11/1986 | Harpell et al. | 428/113 |
| 4,639,387 | A | 1/1987 | Epel | |
| 4,746,029 | A | 5/1988 | Tyner, III et al. | |
| 4,889,258 | A | 12/1989 | Yerushalmi | |
| 4,915,291 | A | 4/1990 | Galber | |
| 4,916,000 | A | 4/1990 | Li et al. | |
| 4,997,091 | A | 3/1991 | McCrea | |
| 5,033,161 | A | 7/1991 | Chavez | |
| 5,054,635 | A | 10/1991 | Kolom | |

(Continued)

FOREIGN PATENT DOCUMENTS

| | | |
|---|---|---|
| GB | 2 262 798 A | 6/1993 |
| GB | 2262798 | 6/1993 |
| GB | 2262885 A | 7/1993 |

OTHER PUBLICATIONS

US 4,367,260, 1/1983, Krause (withdrawn)

*Primary Examiner*—Stephen K. Cronin
*Assistant Examiner*—Niki M. Eloshway
(74) *Attorney, Agent, or Firm*—Virginia Szigeti

(57) ABSTRACT

Blast resistant and blast directing containers, as well as doors and closures therefor, for receiving explosive articles and preventing or minimizing damage in the event of an explosion. The container comprises at least three nested bands of material wherein the bands are oriented relative to one another to substantially enclose a volume and to form a container wall having a thickness substantially equivalent to the sum of the thicknesses of at least two of the bands. The containers have utility as cargo holders, particularly in aircraft where weight is an important consideration, and as transport devices for hazardous materials such as gunpowder and explosives, e.g., bombs and grenades.

35 Claims, 12 Drawing Sheets

U.S. PATENT DOCUMENTS 5,133,258 A 7/1992 Rock et al.
5,170,690 A 12/1992 Smirlock et al.
5,195,701 A 3/1993 Willan
5,225,622 A 7/1993 Gettle et al.
5,238,102 A 8/1993 Langer
5,249,534 A * 10/1993 Sacks ..... 109/24
5,267,665 A 12/1993 Sanai et al.
5,312,182 A 5/1994 Mlakar et al.
5,333,532 A 8/1994 Smirlock et al.
5,376,426 A 12/1994 Harpell et al.
5,413,410 A 5/1995 Mlakar
5,545,455 A * 8/1996 Prevorsek et al. ..... 428/76
5,591,933 A * 1/1997 Li et al. ..... 89/36.02
5,599,082 A 2/1997 Mlakar et al.

* cited by examiner

BLAST RESISTANT AND BLAST DIRECTING CONTAINERS AND METHODS OF MAKING

BACKGROUND OF THE INVENTION

1. Field of the Invention

The present invention relates to containers and methods of making same. More particularly, this invention relates to various blast resistant and blast directing containers, as well as to doors and closures therefor, for receiving explosive articles and preventing or minimizing damage in the event of an explosion. These containers have utility as cargo holders, particularly in aircraft where weight is an important consideration, and as transport devices for hazardous materials such as gunpowder and explosives, e.g., bombs and grenades. They are also particularly useful to bomb squad personnel in combatting terrorist and other threats.

2. The Prior Art

In response to the 1988 terrorist bombing of a Pan American flight over Lockerbie, Scotland, experts in explosives and aircraft-survivability techniques have studied ways to make commercial airliners more resistant to terrorist bombs. One result of these studies has been the development and deployment of new generations of explosive detection devices. As a practical matter, however, there remains a threshold bomb size above which detection is relatively easy but below which an increasing fraction of bombs will go undetected. An undetected bomb likely would find its way into luggage stored in an aircraft cargo container. These cargo containers, shaped as cubic boxes with a truncated edge, have typically been made of aluminum, which is lightweight but not explosion-proof. As a consequence, there has been tremendous focus in recent years on redesigning cargo containers to be both blast resistant to bombs that are below this threshold size and lightweight.

A good overview on redesigned aircraft cargo containers is found in Ashley, S., *SAFETY IN THE SKY Designing Bomb-Resistant Baggage Containers*, Mechanical Engineering, v 114, n 6, June 1992, pp 81–86, hereby incorporated by reference. One type of container disclosed by this article is designed to suppress shock waves and contain exploding fragments while safely bleeding off or venting high pressure gases, while another type is designed to guide explosive products overboard by channeling blast forces out of and away from the airplane hull. Several of the new designs utilize composite materials that are both strong and lightweight. In one such design, a hardened luggage container is wrapped in a blanket woven from low density materials such as SPECTRA® fibers, commercially available from AlliedSignal Inc., and lined with a rigid polyurethane foam and perforated aluminum alloy sheet. A sandwich of this material covers four sides of the container in a seamless shell. In this regard, see also U.S. Pat. No. 5,267,665, hereby incorporated by reference.

Access to a cargo container's interior is necessary for loading and unloading and is typically provided by doors. Doors provide a significant weak point for the container during an explosion since a blast from within the container forces a typical door outward. If the door is connected through a hinge and metal pin arrangement, the pins become dangerous projectiles. If the door slides in grooves or channels, the grooves or channels may bend or distort to cause failure of the container. It would thus be desirable to have a cargo container design that eliminates the aforesaid problems with doors for access to the container's interior. It would also be desirable to be able to retrofit existing cargo containers to avoid these problems. A preferred design would provide a hinge-less and channel-less closure for the access opening to the cargo container.

U.S. Pat. No. 5,312,182 discloses hardened containers wherein the door engages by sliding in grooves/tracks with an interlock that ostensibly responds to such an explosive blast by gripping tighter to resist rupture of the device. Other blast resistant and/or blast directing containers are described in European Patent Publication 0 572 965 A1 and in U.S. Pat. Nos. 5,376,426; 5,249,534; 5,170,690; 4,889.258; 4,432,285; 4,027,601; and 3,786,956. All of these publications are hereby incorporated by reference.

The present invention, which was developed to overcome the deficiencies of the prior art, provides blast resistant and blast directing containers, including doors and closures therefor, and methods of making same. These new containers replace the existing aluminum non-explosion-proof containers currently in use with aircraft.

BRIEF DESCRIPTION OF THE INVENTION

This invention is a container comprising at least three bands of material. A first inner band is nested within a second band which is nested within a third band. The three bands are oriented relative to one another so as to substantially enclose a volume and to form a container wall having a thickness substantially equivalent to the sum of the thicknesses of at least two of the bands.

In a preferred embodiment the container is a blast resistant container comprising three tubular bands of composite material, each of which is substantially rectangular in cross-section. A first inner band, which is rigid, is nested in a second band which, in turn, is nested in a third band. The three bands are nested so as to form a rectangular prism having six faces, each of which has a thickness equivalent to the sum of the thicknesses of at least two of the bands.

The present invention also provides an improvement in a blast resistant container having an access opening. The improvement comprises a hinge-less, channel-less closure for the opening. The closure comprises at least one band of a material which encircles the container to at least partially cover the access opening. In an alternate embodiment, the improvement comprises a self-storing, sliding door comprising a plurality of parallel flexibly connected slats of a rigid material. The slats are mounted on a track affixed to an interior surface of the container adjacent to the opening for sliding in a first direction to expose the opening and for sliding in a second, opposing direction to close the opening.

Another aspect of the present invention provides a blast resistant container comprising at least two tubes substantially coaxially mounted and capable of rotational movement relative to one another. The tubes each have an access opening therein which can be aligned by rotation to permit access to the container and which can be mis-aligned by rotation to permit closure of the container. At least one of the tubes is formed of a blast resistant material. In an alternate embodiment, the blast resistant container comprises at least two spheres concentrically mounted and capable of rotational movement relative to one another. The spheres each have an access opening therein which can be aligned by rotation to permit access to the container and which can be mis-aligned by rotation to permit closure of the container. At least one of the spheres is formed of a blast resistant material.

In yet another aspect, the present invention is an improvement to a blast resistant container, preferably one that is tubular in shape and open at its ends. The improvement comprises a composite strip attached to and reinforcing the container wherein the strip comprises a tape of unidirectional high strength fibers or oriented film encircling the container in a hoop direction at least once.

In another aspect, the present invention is a blast resistant container comprising at least two boxes and at least one rigid band. One of the boxes is nested within the other box with its open side facing into the other box and with the band encircling the nested boxes. For example, two cubes, each having five sides and one open face, are nested together with a four-sided band surrounding the box to prevent the two cubes from moving away from each other during an explosive event. At least one of the boxes and the rigid band are formed of a blast resistant material.

The invention also is a blast directing container or tube comprising at least one rigid, substantially seamless band of blast resistant material. The band has two open sides, and the blast resistant material comprises a network of high strength fibers in a resin matrix, at least about 10, preferably at least about 50, more preferably at least about 75, weight percent of the fibers comprising continuous lengths in the direction of the band.

This invention is also a method of making at least one blast resistant band which comprises the steps of:

A. wrapping at least one flexible sheet comprising a high strength fiber material around a mandrel in a plurality of layers under tension sufficient to remove voids between successive layers;

B. securing the layers of material together to form a substantially seamless, preferably rigid, first band; and C. removing the band from the mandrel.

This invention also comprises a method of making a plurality of bands for assembly into a blast resistant container. This method comprises the steps of:

A. wrapping a first flexible sheet of a high strength fiber material around a mandrel in a plurality of layers under sufficient tension to remove voids between successive layers to form a first band;

B. contacting the high strength fiber material of the first flexible sheet with a resin matrix;

C. placing spacing means on the exterior of the first band;

D. wrapping a second flexible sheet of a high strength fiber material around the spacing means in a plurality of layers under sufficient tension to remove voids between successive layers to form a second band;

E. contacting the high strength fiber material of the second flexible sheet with a resin matrix;

F. placing second spacing means on the exterior of the second band;

G. wrapping a third flexible sheet of a high strength fiber material around the second spacing means in a plurality of layers under sufficient tension to remove voids between successive layers to form a third band:

H. contacting the high strength fiber of the third flexible sheet with a resin matrix;

I. repeating the placing, wrapping, and contacting steps to create a desired number of bands;

J. consolidating at least a part of each of the bands on the mandrel; and

K. removing the bands and spacing means from the mandrel.

The three band box design of the container of this invention has several advantages over containers of the prior art. It eliminates the need for an entry door since access can be achieved through the open side or sides of the innermost band. This eliminates one of the weak points of the prior art containers: door and panel hinges with steel rods are no longer necessary and neither are door-channel interlock systems. Other modifications permit easy access to the container's interior for loading and unloading in spite of limited exterior space constraints. The box is not impervious to explosive's gas and allows controlled release of the gas through the corners which contributes to the design function. The box production is technology inexpensive and simple. The bands of the box can be made rigid or flexible as desired. If the bands of the box are made with flexible edges and rigid faces, then they can be collapsed for more efficient storage and transported as a set of three or more essentially flat parts (bands) for subsequent assembly and use. In a similar fashion, the bands for retrofitting containers and providing door closures, etc., can be made selectively rigid and/or flexible to achieve similar advantages.

BRIEF DESCRIPTION OF THE DRAWINGS

The invention will be more fully understood and further advantages will become apparent when reference is made to the following drawing figures and the accompanying description of the preferred embodiments wherein.

DETAILED DESCRIPTION OF THE INVENTION

Figure 1A:
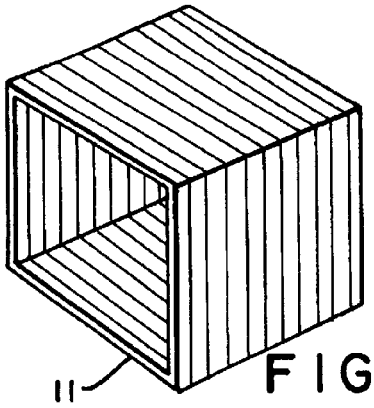
FIG. 1A is a three dimensional view of band 11 which forms part of container 10 of FIG. 1F.

The preferred invention will be better understood by those of skill in the art with reference to the above figures. The preferred embodiments of this invention illustrated in the figures are not intended to be exhaustive or to limit the invention to the precise form disclosed. It is chosen to describe or to best explain the principles of the invention and its application and practical use to thereby enable others skilled in the art to best utilize the invention. In particular, the bands of blast resistant material are shown in the accompanying drawings with parallel lines representing substantially continuous fibers/filaments in the hoop direction of the bands, i.e., as unidirectional fibrous bands. This representation is for ease in understanding the invention—while it constitutes one fabric contemplated for use in the present invention, it is not the exclusive fabric, and in fact, the most preferred fabric contemplated for use is a cross-ply of continuous fibers/filaments, as detailed in the accompanying examples; depicting this, however, would have confused rather than clarified understanding of the present invention.

Initial discussion of the drawing figures will be directed to design considerations followed by a discussion of appropriate materials and how they affect blast resistance and/or blast directing capabilities of the structures.

Figure 1B:
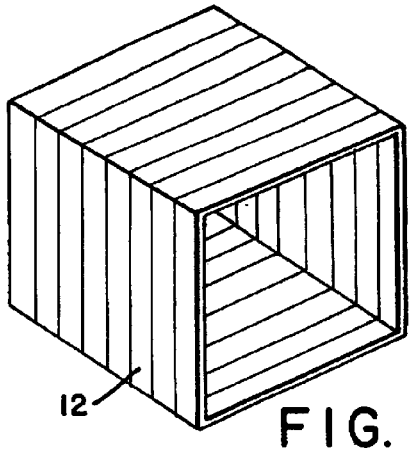
FIG. 1B is a three dimensional view of band 12 which forms part of container 10 of FIG. 1F.
Figure 1C:
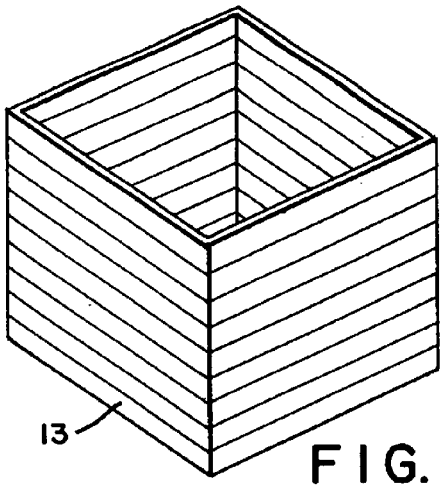
FIG. 1C is a three dimensional views of band 13 which, when assembled with bands 111 and 12, constitute container 10 of FIG. 1F.
Figure 1D:
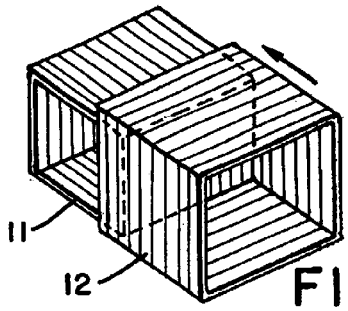
FIG. 1D is a three dimensional partial assembly view which together with FIG. 1E illustrates the assembly sequence for container 10.
Figure 1E:
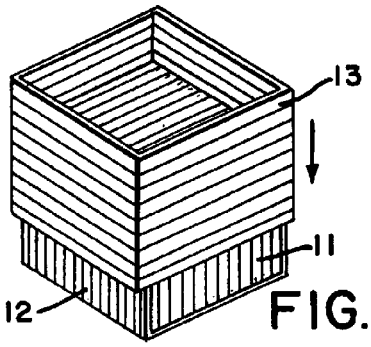
FIG. 1E is a three dimensional partial assembly view which together with FIG. 1D illustrates the assembly sequence for container 10.
Figure 1F:
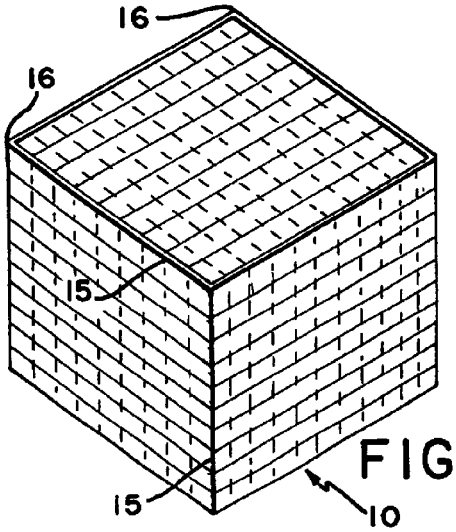
FIG. 1F is a three dimensional assembly view of cargo container 10.
Figure 1G:
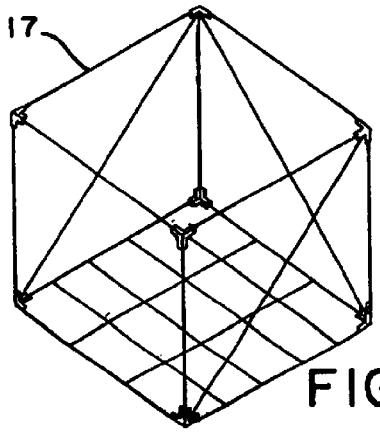
FIG. 1G is a three dimensional view of an optional support structure 17 for inclusion in the assembly of container 10.

Referring to FIG. 1F, the numeral 10 indicates an assembled blast resistant container. The construction of container 10 is critical to the advantages of this invention. Container 10 comprises a set of at least three nested and mutually reinforcing four-sided continuous bands of material 11, 12, and 13 assembled into a cube. See FIGS. 1A, 1B, and 1C. By "band" is meant a thin, flat, volume-encircling strip. The cross-section of the encircled volume may vary, although polygonal is preferred to circular, with rectangular being more preferred and square being most preferred, as depicted. With reference to FIGS. 1D and 1E, a first inner band 11 is nested within a slightly larger second band 12 which is nested within a slightly larger third band 13, all with their respective longitudinal axes perpendicular to one another. In this fashion, each of the six panels forming the faces of cubic container 10 will have a thickness substantially equivalent to the sum of the thicknesses of at least two of the bands 11, 12 and 13, where they overlap, and every edge 15 of container 10 is covered by at least one band of material, 11, 12, or 13. Stated differently, after the load (explosive or luggage) is placed in the first band 11, the second structurally similar band 12 of slightly larger dimensions is placed over the first so that its longitudinal axis is perpendicular to that of first band 11 (see FIG. 1D). The third, similar yet larger, band 13 is slid over the second band 12, so that its longitudinal axis is perpendicular to the axes of both bands 11 and 12 (see FIG. 1E). The third band 13 completes the preferred blast resistant container 10. The fit between bands 11, 12 and 13 is not intended to be a gastight seal, but is a close fit to permit gas to vent gradually, in the event of an explosion, from the corners 16 of cubic container 10. It is preferred that the bands slide on one another, and therefore the frictional characteristics of their surfaces may need to be modified, as will be discussed in more detail later. Container 10 does not have a separate entry door and thus avoids all of the limitations presented by the same in the prior art. FIG. 1G depicts a weight/load bearing frame 17 which may optionally be nested within container 10 in the event that container 10 is insufficiently rigid for bearing the items to be loaded therein. Inner band 11 is slipped over the frame initially, and then assembly proceeds as earlier discussed. Frame 17 may be made from metal or structural composite rods designed in a way to optimize the load bearing capacity of the structure and to minimize container weight.

Figure 2A:
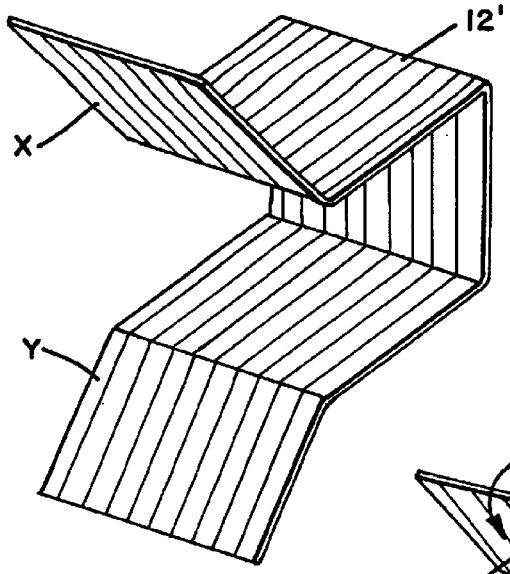
FIG. 2A is a three dimensional view of alternate band 12' with flaps X and Y.
Figure 2B:
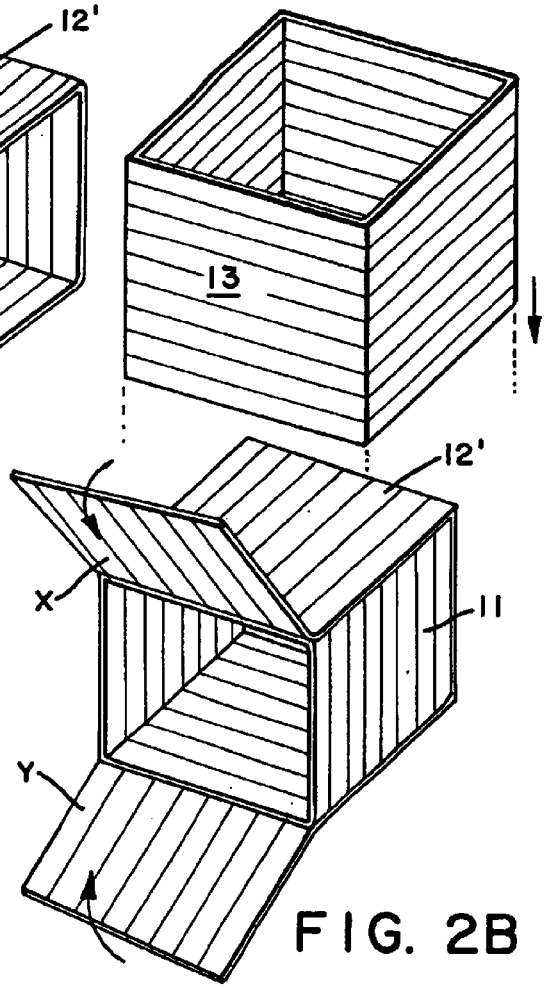
FIG. 2B is a three dimensional partial assembly view that illustrates the assembly sequence for container 10'.
Figure 2C:
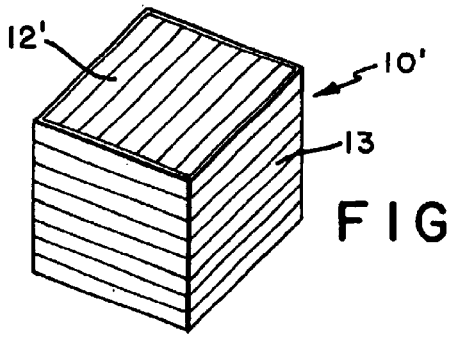
FIG. 2C is a three dimensional assembly view of cargo container 10'.

In a variation on the basic design, second band 12 is replaced by band 12', which is a five-sided, discontinuous strip (see FIG. 2A), i.e., band 12' comprises five substantially rectangular, preferably square as depicted, surfaces in series, which is one more than the four sides forming the rectangular cross-section thereof. Bands 11 and 13 are the same as in the basic design. With reference to FIG. 2B, band 12' is wrapped around inner band 11 with its first and fifth sides overlapping at one of the open sides of first band 11 to create flaps X and Y. Third band 13 completes the blast resistant container 10'. Access to one side of cubic container 10' is achieved by removal of band 13 and opening flaps X and Y. In this embodiment, band 12' preferably is a nested band to prevent flaps X and Y being blown open during an explosion. Container 10' does not have a separate entry door and thus avoids all of the limitations presented by the same in the prior art. As with the basic design, a weight/load bearing frame 17 (see FIG. 1G) may optionally be nested within container 10' in the event that container 10' is insufficiently rigid for bearing the items to be loaded therein. Inner band 11 is slipped over the frame initially, and then assembly proceeds as earlier discussed. Frame 17 may be made from metal or structural composite rods designed in a way to optimize the load bearing capacity of the structure and to minimize container weight. Alternatively, a rigid inner liner or band can be constructed and used, as discussed, infra.

Figure 3A:
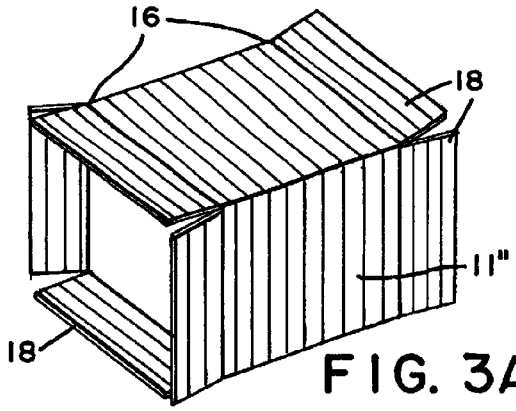
FIG. 3A is a three dimensional view of alternate band 11" cut at corners 16 to create portions which when folded will create lips 18.
Figure 3B:
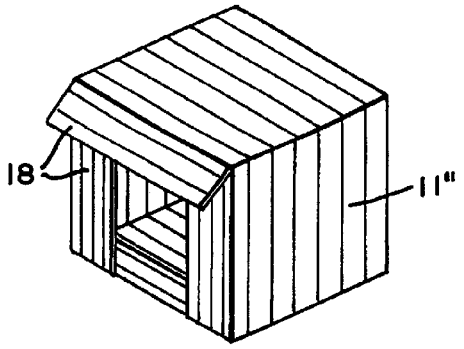
FIG. 3B is a three dimensional view of alternate band 11" with lips 18.
Figure 3C:
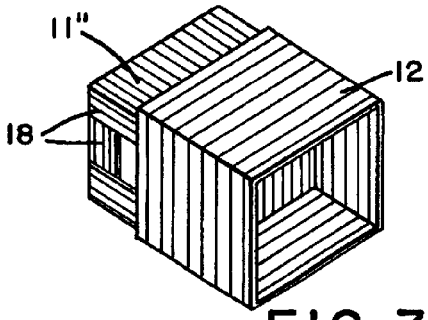
FIG. 3C is a three dimensional partial assembly view that illustrates the assembly sequence for container 10"

With reference to FIGS. 3A, 3B AND 3C which depict another variation on the basic design, inner band 11 is replaced by inner band 11" which has lips 18 formed on both sides thereof prior to assembly with the other bands 12 and 13. Band 11" can be made wider than needed, cut at each corner 16, and folded to create lips 18 on each side (see FIGS. 3A and 3B). Lip 18 is a projecting edge or small flap which is substantially perpendicular to the plane of band 11" in use—the next outermost band (in this instance band 12) will hold flap 18 in this relationship to band 11". The presence of lips 18 during an explosion of the container serves to limit the rate at which hot gases escape from the container after an explosion; this serves to prevent damage to nearby people and property, as well as to decrease the danger of the container catching fire. Any inside band can be formed with lips; however, best results are obtained with the lips 18 on the innermost band 11".

Figure 4:
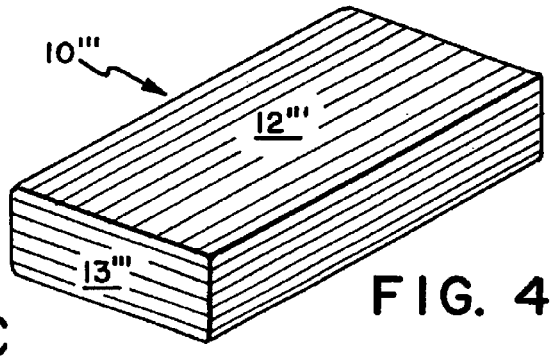
FIG. 4 is a three dimensional assembly view of container 10'"
Figure 5A:
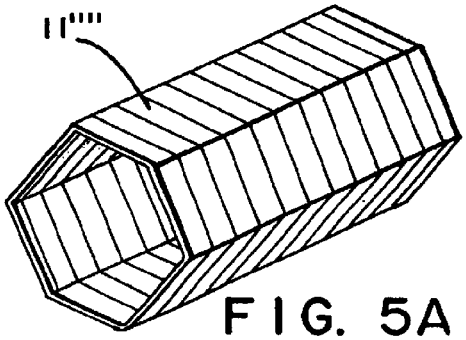
FIG. 5A is a three dimensional view of alternate band 11"" which is hexagonal in cross-section.
Figure 5B:
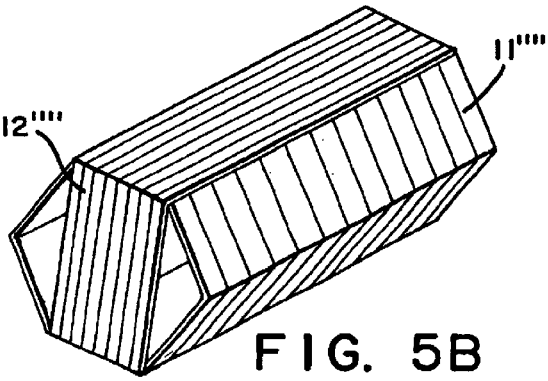
FIG. 5B is a three dimensional partial assembly view of alternate bands 11"" and 12""
Figure 5C:
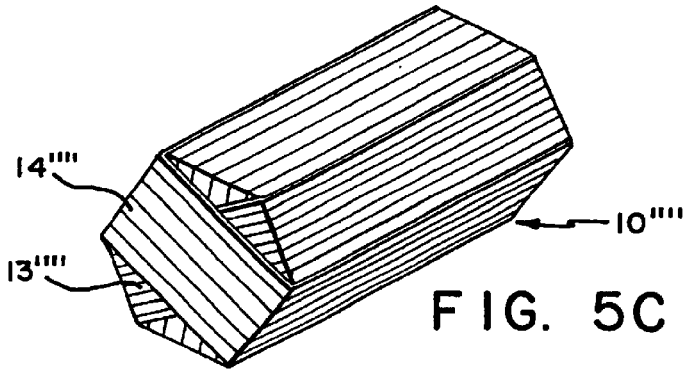
FIG. 5C is a three dimensional assembly view of container 10""

Many differing container shapes are contemplated by the present invention. For instance, the container 10''' of FIG. 4 encloses a non-cubic rectangular prism due to the differing rectangular cross-sections of its three bands. In FIG. 5C is shown container 10'''' formed by a first inner band 11'''' (see FIG. 5A), substantially hexagonal in cross-section, nested in four-sided band 12'''' (FIG. 5B), which is nested in four-sided band 13'''', which is nested in four-sided band 14''''. The preference for the bands to have a polygonal cross-section is derived from the tendency for the container to deform to increase the internal volume during an explosion.

Figure 6A:
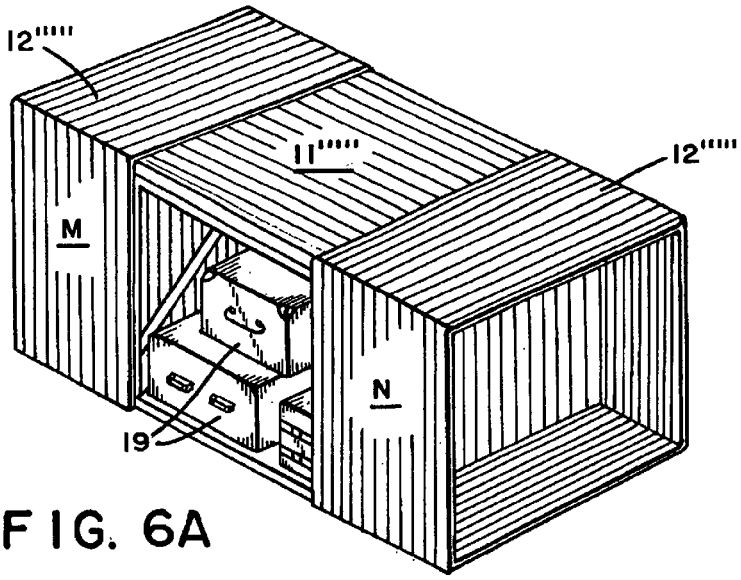
FIG. 6A is a three dimensional partial assembly view that illustrates a two part (M and N) equivalent to band 12 for use with container 10"" of the present invention.
Figure 6B:
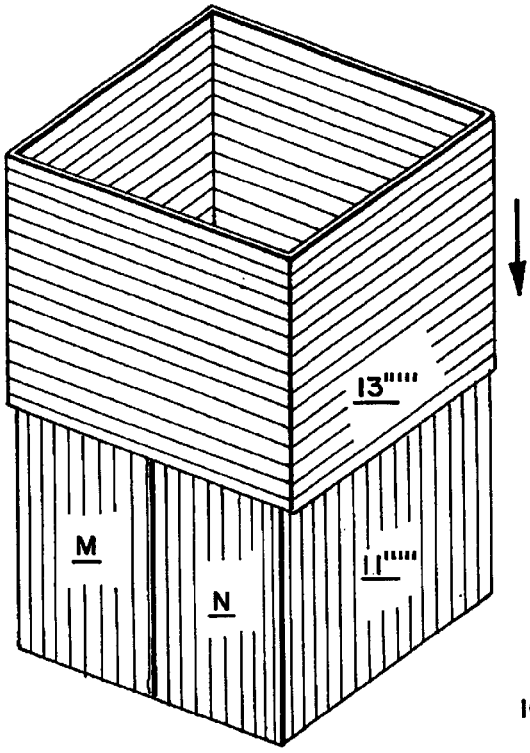
FIG. 6B is a three dimensional partial assembly view similar to FIG. 6A but adding third band 13""
Figure 6C:
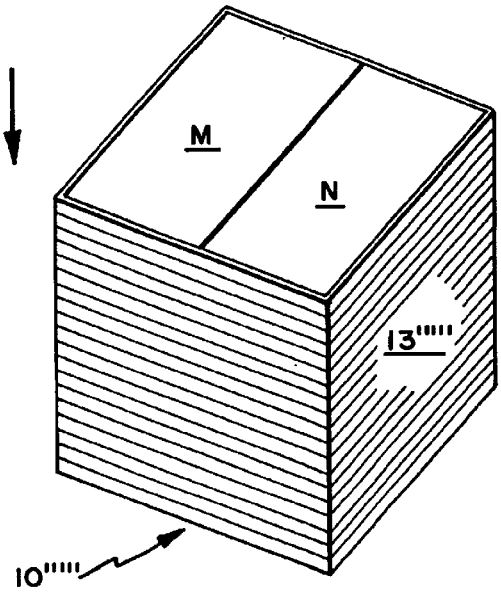
FIG. 6C is a three dimensional assembly view of container 10""

It should be appreciated by now that substantially more than three bands can readily be utilized in the present invention, even with the basic cube (or rectangular prism) design of the container. With reference to FIGS. 6A, 6B, and 6C, which depict cubic container 10''''', second band 12''''' is split by design into two identical parallel and coaxial parts M and N in which inner band 11''''' is nested (or, which are placed over inner band 11'''''). The assembly of band 11''''' is with smaller parts (bands) M and N nested in outer band 13'''''. Such a container 10''''' would be much easier to load and unload than a comparable container 10 of standard aircraft size, i.e., 6×6×6 ft. By way of example, loading takes place when the first band 11''''' is placed on a beam by a conventional lifting fork. Subsequently first band 11''''' is see-sawed up for band M to be placed around it. Band 11''''' is then stabilized for items 19 to be loaded onto first band 11'''''. After loading, band 11''''' is then see-sawed in the other direction to permit band N to be placed therearound. Thereafter the assembly is stabilized and band 13''''' is placed over the assembled bands as shown in FIGS. 6B and 6C. The procedure is reversed for unloading container 10'''''. Intermediate parts (bands) M and N do not have to be removed entirely for unloading, and can be slid in whatever direction is preferred, i.e., in opposition to one another, as depicted, or in the same direction. They can also be arranged to telescopically slide in the same direction. Outer band 13''''' could similarly be made out of two or more sections as desired.

Theoretically an unlimited number of coaxial bands can be used in parallel, preferably abutting one another, to substitute for any one band in the basic three-band concept of the invention. On the inner band equivalent, all of the coaxial bands can have lips (e.g., see FIG. 3B) or overlapping flaps (e.g., see FIG. 2B). On the intermediate band equivalent, all of the coaxial bands can have flaps but only those adjacent the edge can have a lip on the side adjacent to the edge. It is preferred that the outermost band comprises a single continuous band.

Figure 7A:
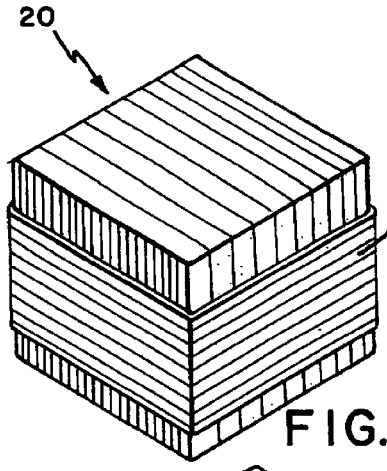
FIG. 7A is a three dimensional assembly view of a blast resistant container 20 in the closed/loaded position.
Figure 7B:
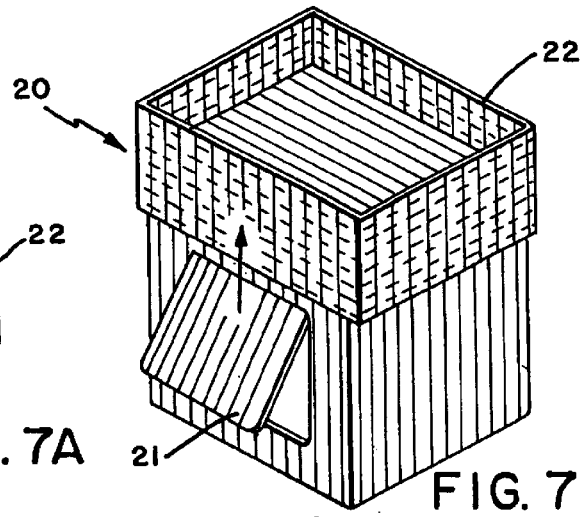
FIG. 7B is a three dimensional assembly view of container 20 in the open/loading position.

FIGS. 7A and 7B depict a blast resistant container 20 that addresses the issue of an effective closure. Container 20 can be a blast resistant container of the prior art with an access opening on one or more sides thereof, or it can be a container with two bands of the three-band concept already discussed and having an access opening on one or more sides thereof FIG. 7B depicts container 20 in the open position for loading or unloading. Flap door 21 provides access to the interior of container 20 from one side; there can be a similar access on one or more of the other side faces of the container. It is preferred that both the door and container be formed of a rigid material, which will be detailed later. A rigid band 22, preferably square in cross-section, is slipped onto container 20 to encircle its side faces and thereby secure closure of container 20 (see FIG. 7A). Band 22 may cover all or only a small fraction of flap door 21 when closed. Band 22 slides to one side of flap door 21, as depicted in FIG. 7B, or completely off of container 20 to permit access through door 21. The shape of band 22's inner cross-section should conform to the portion of the container that it encircles. A polygonal cross-section is preferred with rectangular being more preferred and square (as depicted) being most preferred. Closure via this design is achieved without hinges (and the attendant, potentially lethal pins) or channels. During an explosion, band 22 holds door 21 in place.

Figure 8A:
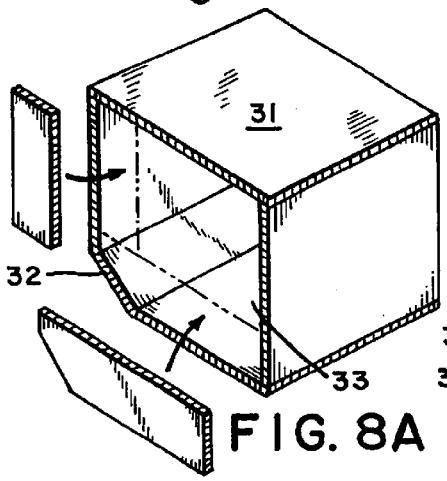
FIG. 8A is a three dimensional view of an inner shell 31 for a blast resistant container 30 with loading/unloading capabilities when in restricted space.
Figure 8B:
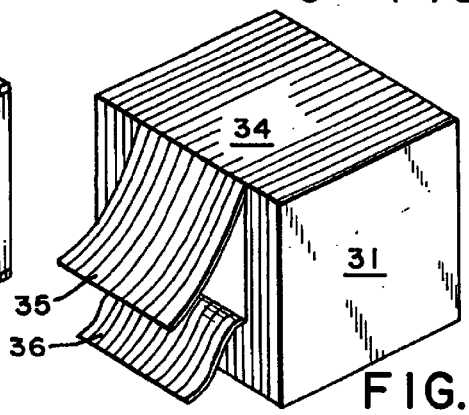
FIG. 8B is a three dimensional partial assembly view of container 30.
Figure 8C:
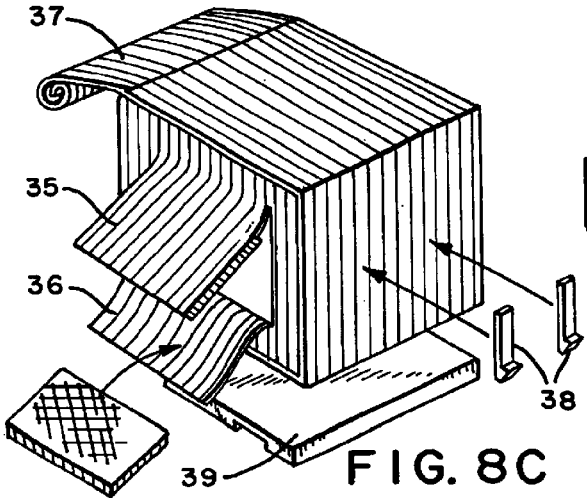
FIG. 8C is a three dimensional partial assembly view of container 30.
Figure 8D:
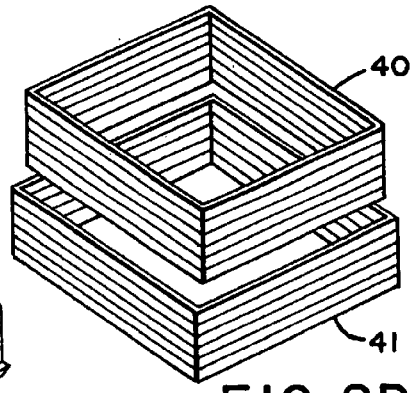
FIG. 8D is a three dimensional view of bands 40 and 41 for use in assembly of container 30.
Figure 8E:
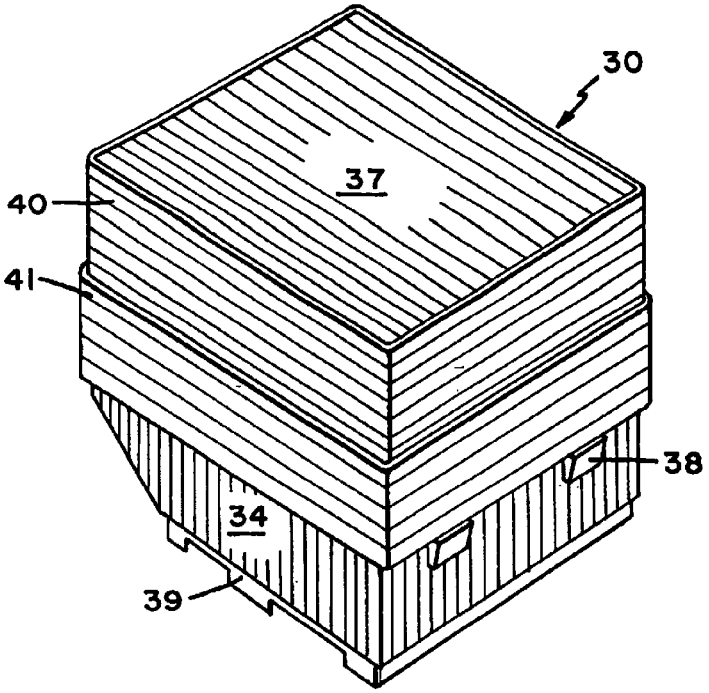
FIG. 8E depicts the assembled container 30 in the closed (loaded) position.
Figure 8F:
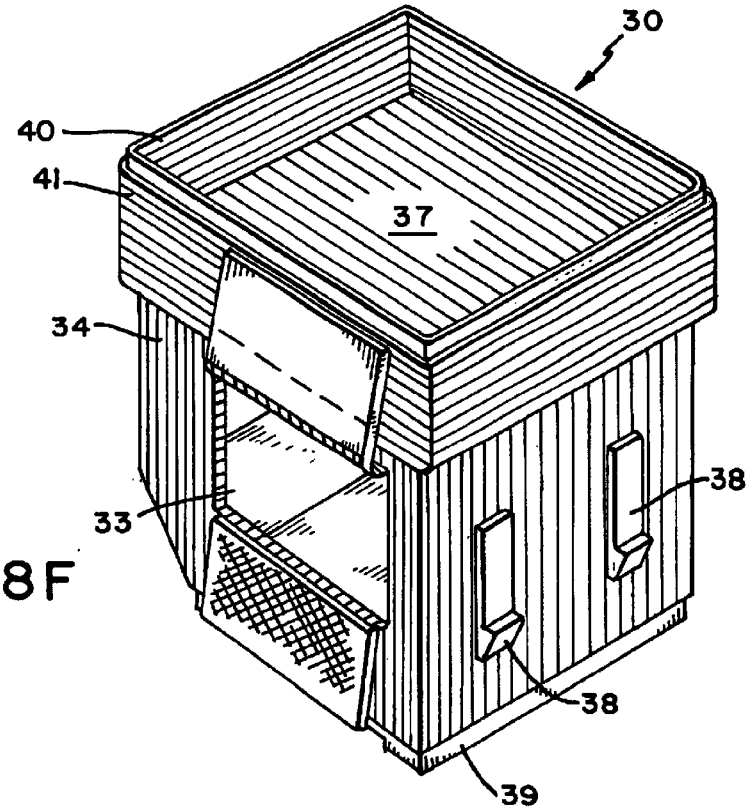
FIG. 8F depicts the assembled container 30 in the open (loading/unloading) position.

FIGS. 8A–8F depict yet another blast resistant container 30 which has loading and unloading capabilities when in a restricted space. This design is very similar to the three-band concept already discussed, which is very blast-containment effective. Modification to the three-band concept is necessary to provide convenient access to the interior of the container 30 within the space constraints of an aircraft cargo hold. In FIG. 8A is depicted a honeycomb core panel 31 which provides structural rigidity to the fully assembled container 30. Panel 31 is a essentially a cube with a truncated edge 32 and an opening 33 on one face that will provide the basis for access to the interior of container 30 when assembled. A first inner band 34 is placed around panel 31 so that it covers opening 33. The material forming band 34, as will be discussed in detail later, is flexible and can be cut to create an upper 35 and a lower 36 access flap in band 34 at opening 33. The intermediate band 37 is a continuous strip/band under which floor panel 39 is attached (see FIG. 8C). The outer band is a two-piece vertically sliding band consisting of sections 40 and 41 that can slide and telescope one 40 within the other 41 to open container 30. Although it is preferred that sections 40 and 41 together completely cover flaps 35 and 36 when container 30 is closed, they may cover somewhat less than all of this area and still be effective. The interior of section 41 is sized slightly larger than the exterior of section 40 (see FIG. 8D) so that it can slide up over it to completely open access 33 as shown in FIG. 8F. Stops 38 are provided on the side of container 30. The rim on the bottom of stop 38 secures section 41 from falling down to the floor while the top of stop 38 secures section 40 from falling down inside of section 41. FIG. 8E depicts the closed completely assembled container 30. The telescoping feature of this design reduces the required extra space for loading or unloading to one-half that of the standard cubic box container. It would reduce the required extra space to one-third in the case of three telescoping sections, etc. Although more than three sections could theoretically be utilized, it would probably be impractical. The telescoping feature of this design could also be used in the closure embodiment depicted in FIGS. 7A and 7B utilizing containers of the prior art.

Figure 9A:
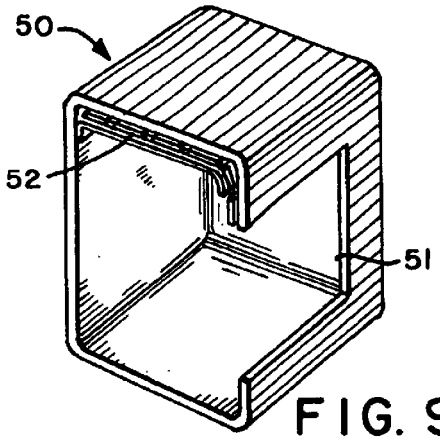
FIG. 9A is a three dimensional view of a portion of blast resistant container 50 having an improved door/closure 51 in the open position.
Figure 9B:
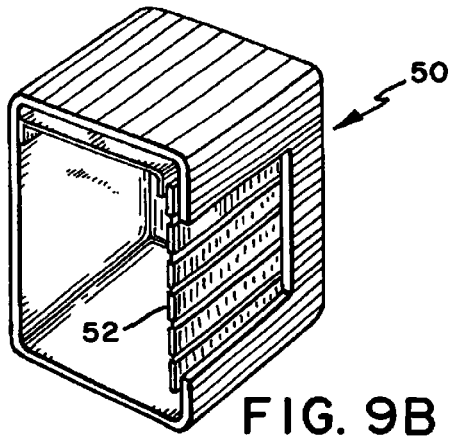
FIG. 9B is a three dimensional view of a portion of blast resistant container 50 having an improved door/closure 51 in the closed position.

In the alternate embodiment depicted in FIGS. 9A and 9B, closure for side access 51 to container 50 is provided by a blast resistant, self-storing, sliding door. The door comprises a plurality of substantially parallel, flexibly connected slats 52 of a rigid material. Slats 52 preferably comprise a plurality of honeycomb sections wrapped in a blast resistant fabric and separated by stitches in the fabric between the sections. The connected slats 52 are mounted on a track (not shown) affixed to an interior surface of container 50 adjacent to the opening 51 for sliding in a first, upward direction to expose opening 51 and for sliding in a second, opposing direction to close opening 51. In the open position of FIG. 9A the door resides inside container 50 adjacent to the ceiling. A handle (not shown) could be attached to the exterior of the sliding door to aid in opening and closing. This design would facilitate loading and unloading within the air cargo hold due to its self-storing capability. A closure band or bands like those of FIGS. 7A, 7B, 8E and 8F could optionally be used to advantage with this door design, as well as the mini-bands 121 that are described hereafter in conjunction with FIG. 16.

Figure 10A:
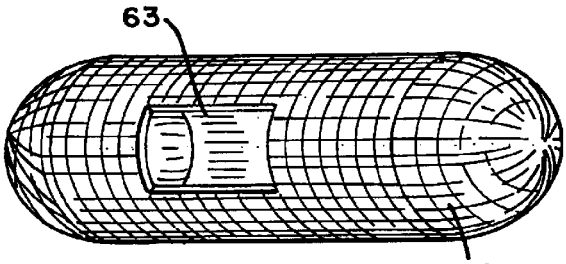
FIG. 10A is a three dimensional view of inner tube 61 for tubular blast resistant container 60.
Figure 10B:
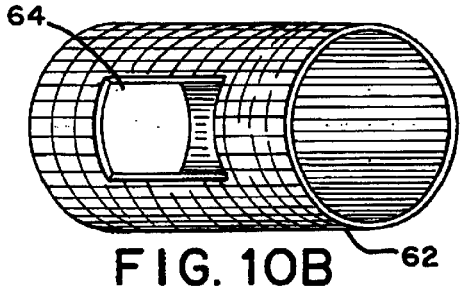
FIG. 10B is a three dimensional view of outer tube 62 for container 60.
Figure 10C:
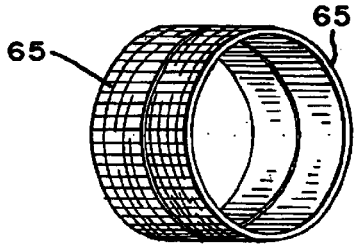
FIG. 10C is a similar view of optional bands 65 for use with container 60.
Figure 10D:
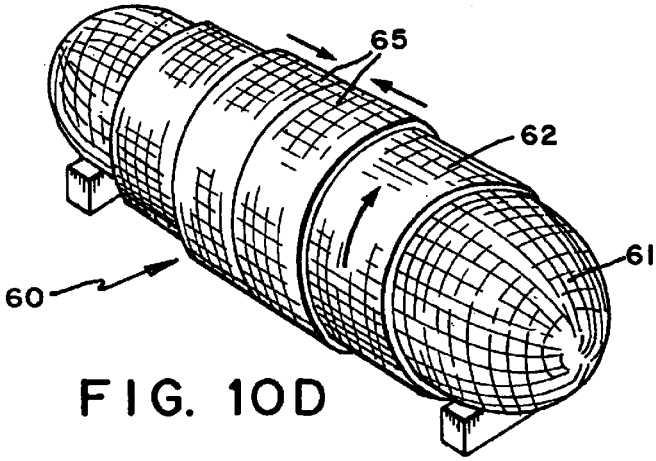
FIG. 10D is a three dimensional assembly view of container 60 in the closed, loaded position with the optional bands 65 in place.

With reference to FIG. 10D, yet another blast resistant container 60 is shown. This container 60 comprises as its major parts at least two tubes 61 and 62 substantially coaxially mounted and capable of rotational movement relative to one another when assembled. It is preferred that the inner tube 61 be closed on its ends (see FIG. 10A) while the outer tube 62 is open on its ends to form a cylindrical tube (see FIG. 10B) that slides onto the inner tube 61. As shown in FIG. 10D, the outer cylindrical tube 62 does not rest on the supporting floor but can be rotated about inner tube 61. Such rotation is facilitated by putting a low friction film (not shown) on either or both of the adjacent surfaces of tubes 61 and 62, or alternatively, through the use of a band of ball bearings (not shown). The length dimension of cylindrical tube 62 substantially corresponds to the length of the cylindrical midsection of tube 61. Both tubes 61 and 62 have access openings, 63 and 64, respectively, preferably of approximately the same size. Openings 63 and 64 can be aligned by rotation of tubes 61 and 62 to permit access to the interior of container 60, and they can be mis-aligned by rotation to permit closure of the container 60. At least one of the tubes is formed of a blast resistant material, as will be detailed later, and preferably both are formed of blast resistant material. Optional but preferred is the use of reinforcing circular bands 65 which are placed over the closed container 60 over tube 62. Although two bands 65 are shown in FIGS. 10C and 10D as preferred, more or less could be utilized to advantage. Similarly, the mini-bands that are described more fully in conjunction with FIG. 16 below could optionally be used to advantage here—the mini-band(s) 121 would preferably be affixed to and encircle the open tube 62 in a hoop direction for reinforcement thereof.

Figure 11A:
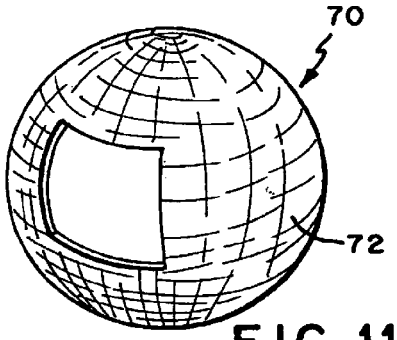
FIG. 11A is a three dimensional assembly view of a spherical blast resistant container 70 in the open position.
Figure 11B:
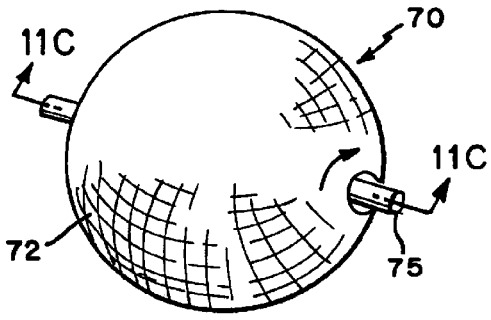
FIG. 11B is a similar three dimensional assembly view of container 70 in the closed position.
Figure 11C:
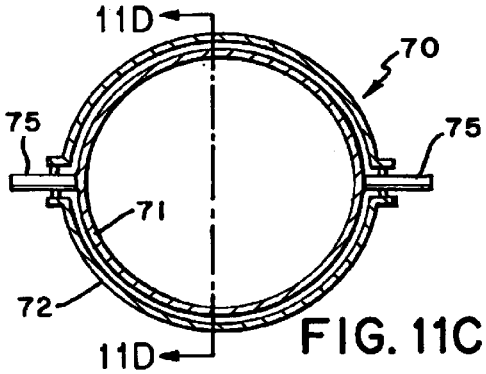
FIG. 11C is a section view taken on the line C—C of FIG. 11B.
Figure 11D:
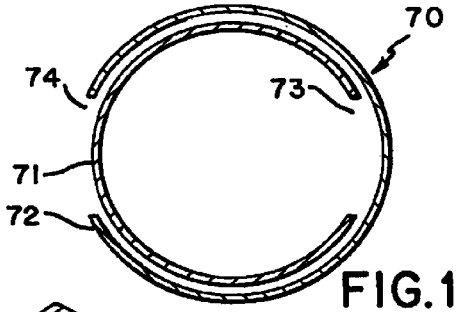
FIG. 11D is a view taken on the line D—D of FIG. 11C.
Figure 12A:
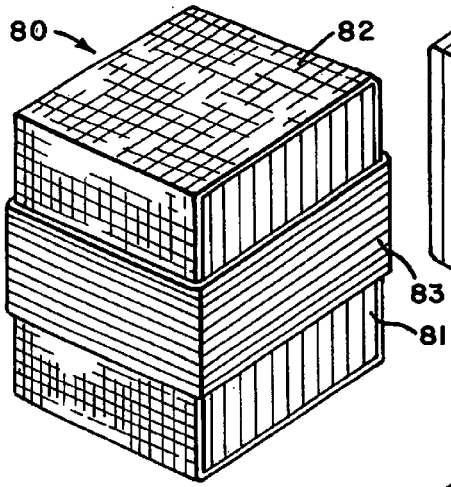
FIG. 12A is a three dimensional assembly view of another blast resistant container 80 in the closed, loaded position.
Figure 12B:
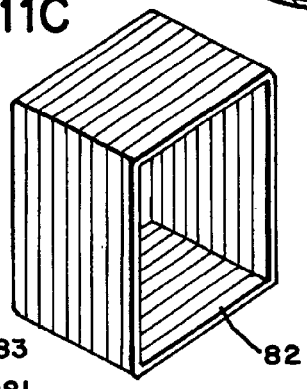
FIG. 12B is a three dimensional view of open box 82 of container 80.
Figure 12C:
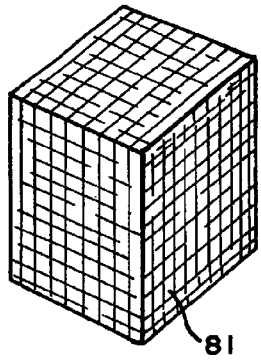
FIG. 12C is a three dimensional view of open box 81 of container 80.
Figure 12D:
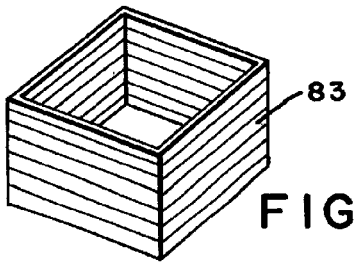
FIG. 12D is a three dimensional view of band 83 for use in assembly of container 80.

FIGS. 11A–D show a spherical container 70 similar in concept to the tubular container 60 of FIGS. 10A–D. Two spheres 71 and 72, having similar access openings 73 and 74, respectively, are concentrically mounted with the smaller of the two, 71, mounted within the other, 72. With reference to FIG. 11B, inner sphere 71 has two poles/handles 75 attached thereto to permit its rotation within outer sphere 72. Alternatively, a band of ball bearings can be provided around the equators of the spheres to facilitate their rotation relative to one another. Spheres 71 and 72 can be rotated relative to one another to align openings 73 and 74 to permit access to the interior of sphere 71 or to mis-align openings 73 and 74 to close container 70. At least one, preferably both, of the spheres is formed of a blast resistant material. Here also, reinforcing circular bands and/or mini-bands can optionally be used to advantage.

With reference to FIGS. 12A–D, in another aspect, the present invention is a blast resistant container 80 comprising at least two open boxes, 81 and 82, and at least one rigid band 83. One of the boxes 81 is nested within the other box 82 with its open side facing into the other box 82 and with the band 83 encircling the nested boxes 81 and 82. The shapes of open boxes 81 and 82 are substantially the same with the dimensions of open box 81 being slightly smaller than those of open box 82 so that they can fit into one another. At least one of the boxes 81 or 82, preferably both, and the rigid band 83 are formed of a blast resistant material. Although boxes 81 and 82, and thus container 80, are depicted as rectangular, i.e., having four upright sides and a flat bottom, they could be of a different shape. Specifically, the open boxes could be cup shaped with curved sides or they could have a differing number of sides to the box, three at a minimum.

Figure 13A:
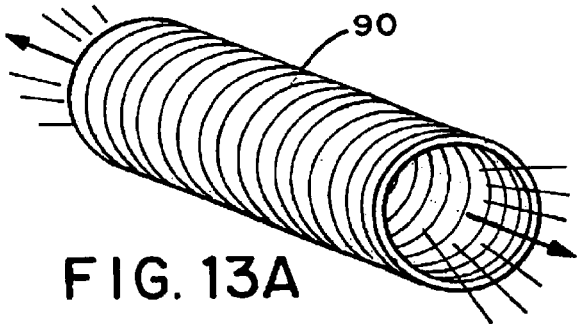
FIG. 13A is a three dimensional view of blast directing tube 90 of the present invention.
Figure 13B:
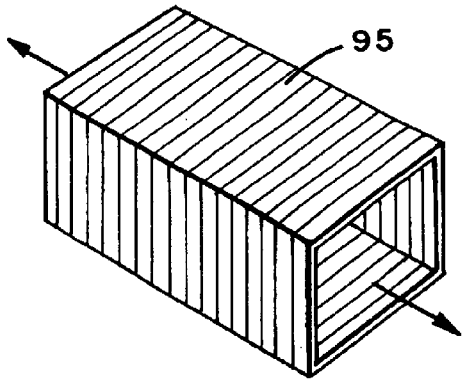
FIG. 13B is a three dimensional view of an alternate blast directing tube 95 of the present invention.
Figure 13C:
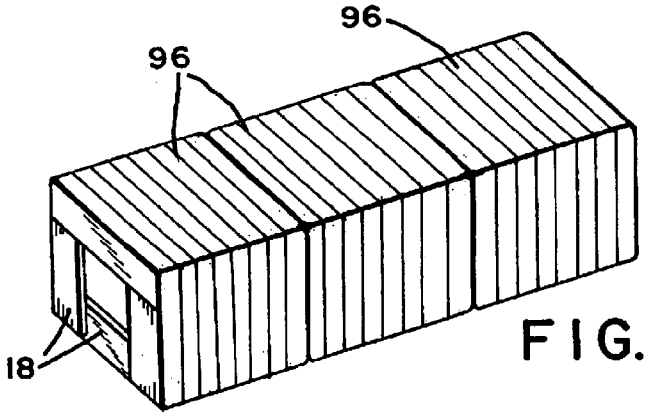
FIG. 13C is a three dimensional view of an assembly of blast-directing tubes of the present invention.

The present invention is also concerned with blast directing containers and tubes. FIG. 13A depicts tube 90, which is a rigid, seamless, cylindrical band of blast resistant material. Explosion of a charge placed in the center of tube 90 will discharge through the open ends of tube 90 in the direction of the arrows. A preferred cross-section of the tube would be rectangular, more preferably square. See tube 95 of FIG. 13B and discussion accompanying the examples further below. Several tubes/bands 96 of similar size and configuration could be coaxially arranged in an abutting relationship (see FIG. 13C) for directing an explosive blast. Preferred construction would be similar to the bands 11" of FIG. 3B with lips 18 on either open side thereof. Optionally a single larger band could be placed around all of the tubes/bands, e.g., a single tube/band like that of FIG. 13B could be placed around bands similar to those of FIG. 13C. The larger band could be designed to encircle the open ends and sides of the overall arrangement, if desired. As an alternative to the optional single larger band, one or more ropes (not shown) may be placed around all of the tubes. In both of these optional arrangements, the nature of the blast resistant material, as detailed below, is extremely important.

Figure 14A:
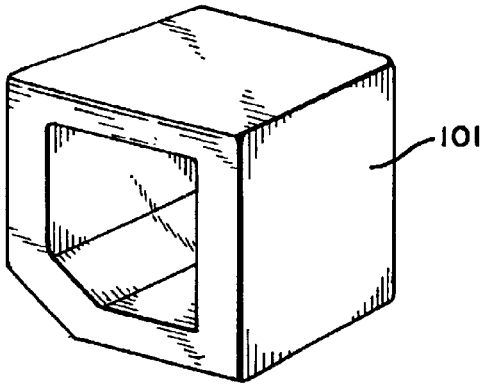
FIG. 14A is a three dimensional view of inner shell 101 of blast directing air cargo container 100.
Figure 14B:
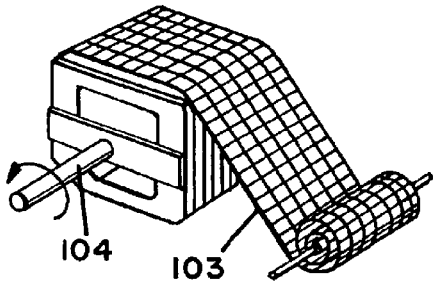
FIG. 14B is a three dimensional partial assembly view of container 100.
Figure 14C:
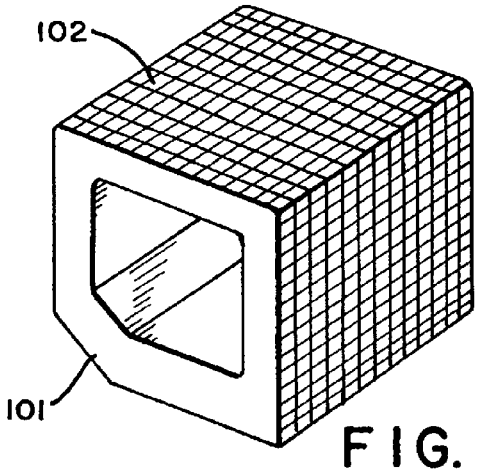
FIG. 14C is also a three dimensional partial assembly view of container 100.
Figure 14D:
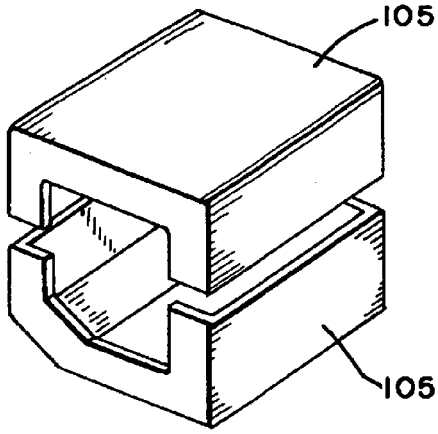
FIG. 14D is a three dimensional view of split shell 105.
Figure 14E:
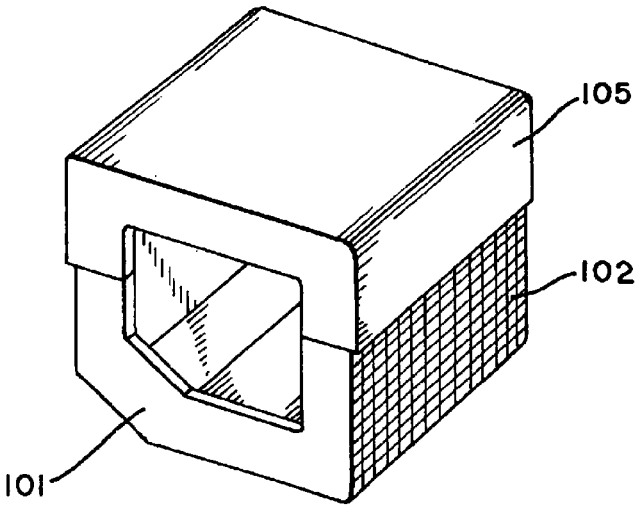
FIG. 14E is a three dimensional partial assembly view of container 100.
Figure 14F:
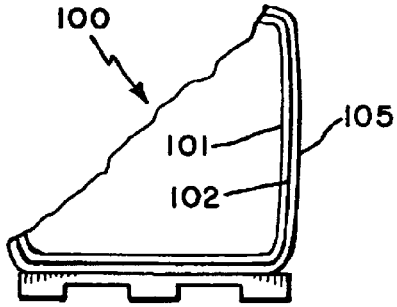
FIG. 14F is a partial section of fully assembled container 100.

The blast directing concept is readily adapted to air cargo containers, as shown in FIGS. 14A–F. Cargo container 100 comprises a truncated shell 101 (see FIG. 14A) with lips defining two open sides or ends. Shell 101 should be formed of a tough, rugged material, preferably a polymeric material, such as a polyethylene powder which can be rotationally molded. A rigid, substantially seamless band 102 of a blast resistant material, detailed below, is placed around shell 101 without blocking access on the open sides or ends, all as shown in FIG. 14C. Band 102 can be formed in several ways, but preferably is formed by wrapping blast resistant material 103 around shell 101 in a plurality of wraps by rotation of shell 101 with handle 104 attached thereto (see FIG. 14B), followed by consolidation of the blast resistant material, to be detailed below. A second truncated shell 105, slightly larger than the assembly of shell 101 and band 102 in FIG. 14C and also formed of a tough, rugged material, preferably a polymeric material, such as a polyethylene, forms the outer covering for container 100. Shell 105 can conveniently be split as shown in FIG. 14D for assembly around assembled shell 101 and band 102, and can optionally be held in place in a conventional manner, e.g., with adhesives, ropes, etc. When a container like this is placed in an aircraft cargo hold with the blast resistant band 102 oriented as shown, band 102 protects the fuselage and passenger sections from the effects of a bomb blast while directing the blast out via its open ends (front and back) into adjacent containers. The polyethylene shell 105 of the air cargo container 100 serves to minimize normal-use damage to the blast-resistant material comprising band 102, especially the high strength fibers therein, which should be intact at the time of an explosion for maximum benefit to be derived therefrom.

Figure 15A:
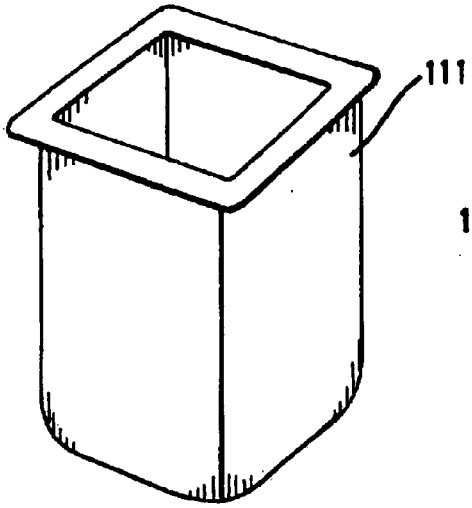
FIG. 15A is a three dimensional view of inner shell 111 of blast resistant container 110.
Figure 15B:
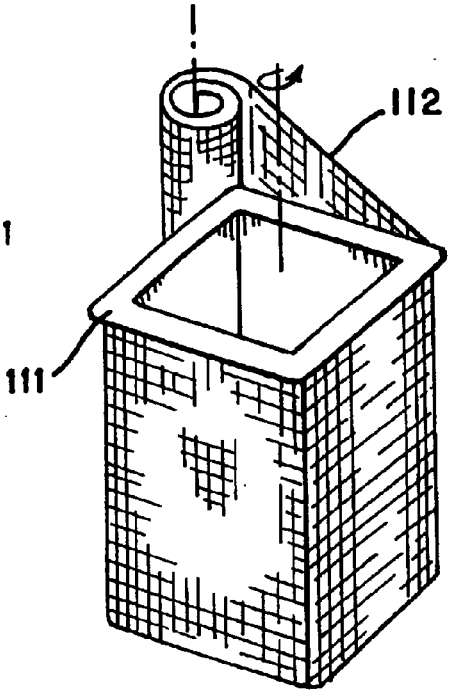
FIG. 15B is a three dimensional partial assembly view of container 110.
Figure 15C:
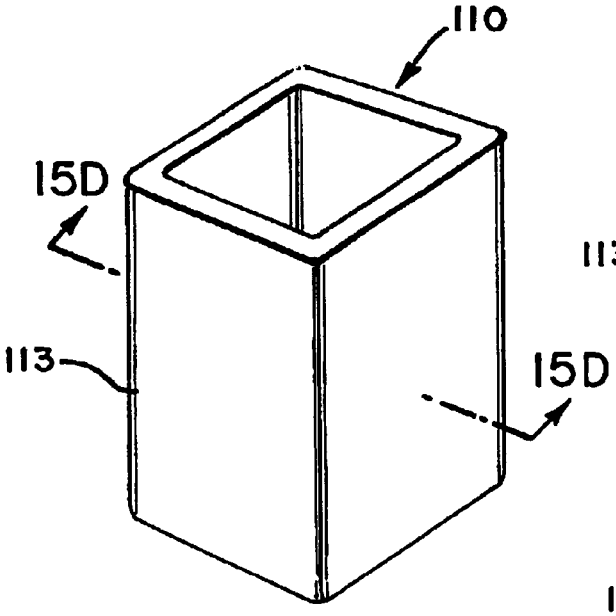
FIG. 15C depicts the assembled container 110 in an upright position.
Figure 15D:
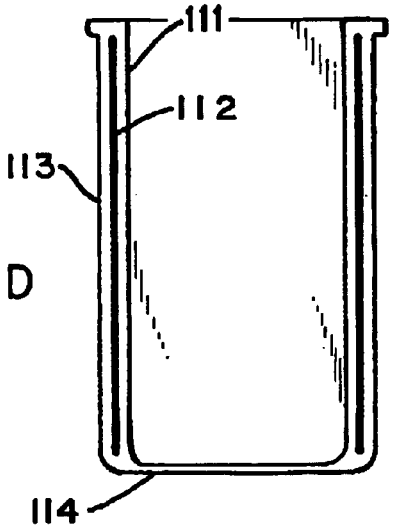
FIG. 15D is a cross-section of container 110 taken on the lines D—D of FIG. 15C.

Another blast directing container 110 is shown in FIG. 15C. This container 110 is a conventional rectangular-shaped trash container liner 111 depicted in FIG. 15A, modified by the inclusion of a substantially seamless band 112 (see FIG. 15B) of a blast resistant material, detailed below. Band 112 can be formed by wrapping blast resistant material around the sides of container liner 111 and consolidating same, or can be preformed for subsequent assembly with container liner 111. The assembly of FIG. 15B can be used alone or can be nested, as shown in FIGS. 15C and D, in an outer shell (liner) 113 to complete the container 110. As shown in FIG. 15D, the base 114 of the trash container 110 does not have blast resistant material therein. In this embodiment, the blast from a bomb placed in such a trash container would be directed both up and down. Alternatively, seamless band 112 could be formed with a base to make it cup shaped (not shown) and the modified container would comprise this rigid cup of blast resistant material nested between two liners/shells. In this instance, the blast from a bomb would be directed upward. Liner 111 and shell 113 are preferably rotationally molded using powders described below.

Figure 16:
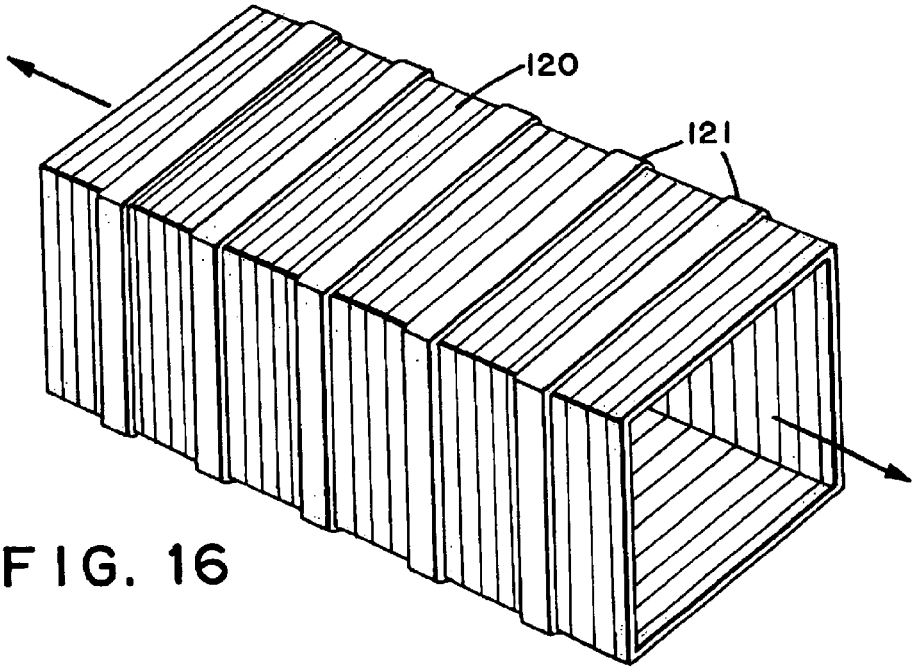
FIG. 16 is a three dimensional view of a blast-directing tube 120 reinforced with mini-bands 121.

FIG. 16 shows an open-ended tube 120 reinforced with a plurality of spaced, substantially parallel mini-bands 121 which help to prevent catastrophic failure of tube 120 during an explosion. Mini-bands 121, which comprise composite strips, are attached to and reinforce tube 120. Each strip comprises a tape of unidirectional high strength fibers or oriented film encircling the container in a hoop direction at least once, more preferably two to three times. The strips are spaced apart a distance of from about 2 to 6 inches (about 5.1 to about 15.3 centimeters), preferably about 3 to 4 inches (about 7.6 to 10.2 centimeters), and cover less than about 20 percent of the surface area of the container to which they are attached. Tube 120 preferably is a rectangular tube in cross-section, more preferably square, as shown. It may be closed or open ended, preferably the latter, as shown. Even a single strategically placed mini-band 121 can help prevent catastrophic failure of the tube.

In the various embodiments depicted, a rigid inner liner or band can be constructed using one or more of the techniques and/or material to follow. The inner liner/band, especially for the liner of FIG. 14, and the trash container and shell of FIG. 15, may be rotationally molded using polyethylene, cross-linkable polyethylene, nylon 6, or nylon 6,6 powders. Technology described in *Plastics World*, p. 60, July, 1995, hereby incorporated by reference, can also be used. Tubes, rods and connectors may be used, preferably formed from thermoplastic or thermoset resins, optionally fiber reinforced, or low density metals such as aluminum. The inner liner/band may utilize a continuous four-sided metal band. Sandwich constructions consisting of honeycomb, balsa wood or foam core with rigid facings may be used. The honeycomb may be constructed from aluminum, cellulose products, or aramide polymer. Weight can be minimized by using construction techniques well known in the aerospace industry. (Carbon fiber reinforced epoxy composites may be used.) A rigid inner shell/band can be constructed from wood using techniques well known to the carpentry trades. (Flame retardant paints may usefully be used.) The rigid inner liner/band may serve as a mandrel onto which the bands are wound and can form part of the final blast container. Alternatively the inner liner can be inserted into the inner band after the band has been constructed.

As used herein with respect to bands, "rigid" means that a band is inflexible across the face or faces thereof. If the band comprises a plurality of faces and edges, then it may be substantially inflexible across the faces but retain its flexibility at the edges and still be considered "rigid." Such a band is also considered "collapsible" since its flexible edges act as pin-less hinges connecting the substantially inflexible faces, and the band can be essentially flattened by folding at least two of its edges. With respect to the faces, flexibility is determined as follows. A length of the material is clamped horizontally along one side on a flat support surface with an unsupported overhang portion of length "L".

The vertical distance "D" that the unclamped side of the overhang portion drops below the flat support surface is measured. The ratio D/L gives a measure of drapability. When the ratio approaches 1, the structure/face is highly flexible, and when the ratio approaches 0, it is very rigid or inflexible. Structures are considered rigid when D/L is less than about 0.2, more preferably less than about 0.1.

The structural designs of the present invention, especially the three band cube design, enhance the blast containment capability of a container. Blast containment capability is also enhanced with increased areal density of the container. The "areal density" is the weight of a structure per unit area of the structure in $kg/m^2$, as discussed in more detail in conjunction with the examples which follow below. The areal density of a cardboard box constructed according to the three band cube design of the present invention is about 0.05 $kg/m^2$, and thus, the areal density should be at least about 0.05 $kg/m^2$. The areal density of the structures of the present invention are thus at least about 0.05 $kg/m^2$, preferably at least about 0.10 $kg/m^2$, more preferably at least about 0.20 $kg/m^2$, and most preferably at least about 1.0 $kg/m^2$.

The preferred blast resistant materials utilized in forming the containers and bands of the present invention are oriented films, fibrous layers, and/or a combination thereof A resin matrix may optionally be used with the fibrous layers, and a film (oriented or not) may comprise the resin matrix.

Uniaxially or biaxially oriented films acceptable for use as the blast resistant material can be single layer, bilayer, or multilayer films selected from the group consisting of homopolymers and copolymers of thermoplastic polyolefins, thermoplastic elastomers, crosslinked thermoplastics, crosslinked elastomers, polyesters, polyamides, fluorocarbons, urethanes, epoxies, polyvinylidene chloride, polyvinyl chloride, and blends thereof. Films of choice are high density polyethylene, polypropylene, and polyethylenelelastomeric blends. Film thickness preferably ranges from about 0.2 to 40 mils, more preferably from about 0.5 to 20 mils, most preferably from about 1 to 15 mils.

For purposes of this invention, a fibrous layer comprises at least one network of fibers either alone or with a matrix. Fiber denotes an elongated body, the length dimension of which is much greater than the transverse dimensions of width and thickness. Accordingly, the term fiber includes monofilament, multifilament, ribbon, strip, staple and other forms of chopped, cut or discontinuous fiber and the like having regular or irregular cross-sections. The term fiber includes a plurality of any one or combination of the above.

The cross-sections of filaments for use in this invention may vary widely. They may be circular, flat or oblong in cross-section. They also may be of irregular or regular multi-lobal cross-section having one or more regular or irregular lobes projecting from the linear or longitudinal axis of the fibers. It is particularly preferred that the filaments be of substantially circular, flat or oblong cross-section, most preferably the former.

By network is meant a plurality of fibers arranged into a predetermined configuration or a plurality of fibers grouped together to form a twisted or untwisted yarn, which yarns are arranged into a predetermined configuration. For example, the fibers or yarn may be formed as a felt or other nonwoven, knitted or woven (plain, basket, satin and crow feet weaves, etc.) into a network, or formed into a network by any conventional techniques. According to a particularly preferred network configuration, the fibers are unidirectionally aligned so that they are substantially parallel to each other along a common fiber direction. Continuous length fibers are most preferred although fibers that are oriented and have a length of from about 3 to 12 inches (about 7.6 to about 30.4 centimeters) are also acceptable and are deemed "substantially continuous" for purposes of this invention.

It is preferred that within a fibrous layer at least about 10 weight percent of the fibers, more preferably at least about 50 weight percent, and most preferably at least about 75 weight percent, be substantially continuous lengths of fiber that encircle the volume enclosed by the container. By encircle the volume is meant in the band or hoop direction, i.e., substantially parallel to or in the direction of the band, as band has been previously defined and shown. By substantially parallel to or in the direction of the band is meant within ±10°. It is also preferred that the bands of the present invention be substantially seamless. By substantially seamless is meant that the band is seamless across each edge joining adjacent faces for more than at least one full wrap of the fibrous layer and also that at any given point on the band there is at least one wrap/layer that is seamless. With this definition, the band 12' of FIG. 2A would be considered substantially seamless, even though its flaps X and Y are not joined to one another.

The continuous bands can be fabricated using a number of procedures. In one preferred embodiment, the bands, especially those without resin matrix, are formed by winding fabric around a mandrel and securing the shape by suitable securing means, e.g., heat and/or pressure bonding, heat shrinking, adhesives, staples, sewing and other securing means known to those of skill in the art. Sewing can be either spot sewing, line sewing or sewing with intersecting sets of parallel lines. Stitches are typically utilized in sewing, but no specific stitching type or method constitutes a preferred securing means for use in this invention. Fiber used to form stitches can also vary widely. Useful fiber may have a relatively low modulus or a relatively high modulus, and may have a relatively low tenacity or a relatively high tenacity. Fiber for use in the stitches preferably has a tenacity equal to or greater than about 2 g/d and a modulus equal to or greater than about 20 g/d. All tensile properties are evaluated by pulling a 10 in (25.4 cm.) fiber length clamped between barrel clamps at 10 in/min (25.4 cm/min) on an Instron Tensile Tester. In cases where it is desirable to make the band somewhat more rigid, pockets can be sewn in the fabric into which rigid plates may be inserted. This is another "collapsible" embodiment of rigid bands, i.e., the faces are rigid due to the presence of the rigid plates, but the edges are flexible due to the flexible fabric forming the bands or can be bent by, e.g., the weight of the rigid face portion. An advantage to the collapsible embodiments of the present invention is that the apparatus can be transported flat and set up immediately prior to use. Another way to make wraps of fabric selectively rigid within a band is by way of stitch patterns, e.g., parallel rows of stitches can be used across the face portions of the band to make them rigid while leaving the joints/edges unsewn to create another "collapsible" rigid band.

The type of fibers used in the blast resistant material may vary widely and can be inorganic or organic fibers. Preferred fibers for use in the practice of this invention, especially for the substantially continuous lengths, are those having a tenacity equal to or greater than about 10 grams/denier (g/d) and a tensile modulus equal to or greater than about 200 g/d (as measured by an Instron Tensile Testing machine). Particularly preferred fibers are those having a tenacity equal to or greater than about 20 g/d and a tensile modulus equal to or greater than about 500 g/d. Most preferred are those embodiments in which the tenacity of the fibers is equal to or greater than about 25 g/d and the tensile modulus is equal to or greater than about 1000 g/d. In the practice of this invention, the fibers of choice have a tenacity equal to or greater than about 30 g/d and a tensile modulus equal to or greater than about 1200 g/d.

The denier of the fiber may vary widely. In general, fiber denier is equal to or less than about 8000. In the preferred embodiments of the invention, fiber denier is from about 10 to about 4000, and in the more preferred embodiments of the invention, fiber denier is from about 10 to about 2000. In the most preferred embodiments of the invention, fiber denier is from about 10 to about 1500.

Useful inorganic fibers include S-glass fibers, E-glass fibers, carbon fibers, boron fibers, alumina fibers, zirconia-silica fibers, alumina-silica fibers and the like.

Illustrative of useful inorganic filaments for use in the present invention are glass fibers such as fibers formed from quartz, magnesia alumuninosilicate, non-alkaline aluminoborosilicate, soda borosilicate, soda silicate, soda lime-aluminosilicate, lead silicate, non-alkaline lead boroalumina, non-alkaline barium boroalumina, non-alkaline zinc boroalumina, non-alkaline iron aluminosilicate, cadmium borate, alumina fibers which include "saffil" fiber in eta, delta, and theta phase form, asbestos, boron, silicone carbide, graphite and carbon such as those derived from the carbonization of saran, polyaramide (Nomex), nylon, polybenzimidazole, polyoxadiazole, polyphenylene, PPR, petroleum and coal pitches (isotropic), mesophase pitch, cellulose and polyacrylonitrile, ceramic fibers, metal fibers as for example steel, aluminum metal alloys, and the like.

Illustrative of useful organic filaments are those composed of polyesters, polyolefins, polyetheramides, fluoropolymers, polyethers, celluloses, phenolics, polyesteramides, polyurethanes, epoxies, aminoplastics, silicones, polysulfones, polyetherketones, polyetheretherketones, polyesterimides, polyphenylene sulfides, polyether acryl ketones, poly(amideimides), and polyimides. Illustrative of other useful organic filaments are those composed of aramids (aromatic polyamides), such as poly(m-xylylene adipamide), poly(p-xylylene sebacamide), poly(2,2,2-trimethyl-hexamethylene terephthalamide), poly (piperazine sebacamide), poly(metaphenylene isophthalamide) and poly(p-phenylene terephthalamide); aliphatic and cycloaliphatic polyamides, such as the copolyamide of 30% hexamethylene diammonium isophthalate and 70% hexamethylene diammonium adipate, the copolyamide of up to 30% bis-(-amidocyclohexyl) methylene, terephthalic acid and caprolactam, polyhexamethylene adipamide (nylon 66), poly(butyrolactam) (nylon 4), poly(9-aminonoanoic acid) (nylon 9), poly (enantholactam) (nylon 7), poly(capryllactam) (nylon 8), polycaprolactam (nylon 6), poly(p-phenylene terephthalamide), polyhexamethylene sebacamide (nylon 6,10), polyaminoundecanamide (nylon 11), polydodecanolactam (nylon 12), polyhexamethylene isophthalamide, polyhexamethylene terephthalamide, polycaproamide, poly (nonamethylene azelamide (nylon 9,9), poly(decamethylene azelamide) (nylon 10,9), poly(decamethylene sebacamide) (nylon 10,10), poly[bis-(4-aminocyclohexyl)methane 1,10-decanedicarboxamide] (Qiana) (trans), or combinations thereof; and aliphatic, cycloaliphatic and aromatic polyesters such as poly(1,4-cyclohexylidene dimethyl eneterephthalate)cis and trans, poly(ethylene-1,5-naphthalate), poly(ethylene-2,6-naphthalate), poly(1,4-cyclohexane dimethylene terephthalate)(trans), poly (decamethylene terephthalate), poly(ethylene terephthalate), poly(ethylene isophthalate), poly(ethylene oxybenzoate), poly(para-hydroxy benzoate), poly(dimethylpropiolactone), poly(decamethylene adipate), poly(ethylene succinate), poly (ethylene azelate), poly(decamethylene sabacate), poly($\alpha$,$\alpha$-dimethylpropiolactone), and the like.

Also illustrative of useful organic filaments are those of liquid crystalline polymers such as lyotropic liquid crystalline polymers which include polypeptides such as poly-$\alpha$-benzyl L-glutamate and the like; aromatic polyamides such as poly(1,4-benzamide), poly(chloro-1-4-phenylene terephthalamide), poly(1,4-phenylene fumaramide), poly (chloro-1,4-phenylene fumaramide), poly(4,4'-benzanilide trans, trans-muconamide), poly(1,4-phenylene mesaconamide), poly(1,4-phenylene)(trans-1,4-cyclohexylene amide), poly(chloro-1,4-phenylene)(trans-1,4-cyclohexylene amide), poly(1,4-phenylene 1,4-dimethyl-trans-1,4-cyclohexylene amide), poly(1,4-phenylene 2,5-pyridine amide), poly(chloro-1,4-phenylene 2,5-pyridine amide), poly(3,3'-dimethyl-4,4'-biphenylene 2,5 pyridine amide), poly(1,4-phenylene 4,4'-stilbene amide), poly (chloro-1,4-phenylene 4,4'-stilbene amide), poly(1,4-phenylene 4,4'-azobenzene amide), poly(4,4'-azobenzene 4,4'-azobenzene amide), poly(1,4-phenylene 4,4'-azoxybenzene amide), poly(4,4'-azobenzene 4,4'-azoxybenzene amide), poly(1,4-cyclohexylene 4,4'-azobenzene amide), poly(4,4'-azobenzene terephthal amide), poly(3,8-phenanthridinone terephthal amide), poly (4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide), poly (1,4-phenylene 2,6-naphthal amide), poly(1,5-naphthalene terephthal amide), poly(3,3'-dimethyl-4,4-biphenylene terephthal amide), poly(3,3'-dimethoxy-4,4'-biphenylene terephthal amide), poly(3,3'-dimethoxy-4,4-biphenylene 4,4'-bibenzo amide) and the like; polyoxamides such as those derived from 2,2'-dimethyl-4,4'-diamino biphenyl and chloro-1,4-phenylene diamine, polyhydrazides such as poly chloroterephthalic hydrazide, 2,5-pyridine dicarboxylic acid hydrazide)poly(terephthalic hydrazide), poly(terephthalic-chloroterephthalic hydrazide) and the like; poly(amide-hydrazides) such as poly(terephthaloyl 1,4 amino-benzhydrazide) and those prepared from 4-amino-benzhydrazide, oxalic dihydrazide, terephthalic dihydrazide and para-aromatic diacid chlorides; polyesters such as those of the compositions include poly(oxy-trans-1,4-cyclohexyleneoxycarbonyl-trans-1,4-cyclohexylenecarbonyl-$\beta$-oxy-1,4-phenyl-eneoxyteraphthaloyl) and poly(oxy-cis-1,4-cyclohexyleneoxycarbonyl-trans-1,4-cyclohexylenecarbonyl-$\beta$-oxy-1,4-phenyleneoxyterephthaloyl) in methylene chloride-o-cresol poly(oxy-trans-1,4-cyclohexylene oxycarbonyl-trans-1,4-cyclohexylenecarbonyl-b-oxy-(2-methyl-1,4-phenylene) oxy-terephthaloyl) in 1,1,2,2-tetrachloroethane-o-chlorophenol-phenol (60:25:15 vol/vol/vol), poly[oxy-trans-1,4-cyclohexyleneoxycarbonyl-trans-1,4-cyclohexylenecarbonyl-b-oxy(2-methyl-1,3-phenylene) oxy-terephthaloyl] in o-chlorophenol and the like; polyazomethines such as those prepared from 4,4'-diaminobenzanilide and terephthalaldehyde, methyl-1,4-phenylenediamine and terephthalaldehyde and the like; polyisocyanides such as poly(-phenyl ethyl isocyanide), poly(n-octyl isocyanide) and the like; polyisocyanates such as poly(n-alkyl isocyanates) as for example poly(n-butyl isocyanate), poly(n-hexyl isocyanate) and the like; lyotropic crystalline polymers with heterocyclic units such as poly(1, 4-phenylene-2,6-benzobisthiazole) (PBT), poly(1,4-phenylene-2,6-benzobisoxazole) (PEO), poly(1,4-phenylene-1,3,4-oxadiazole), poly(1,4-phenylene-2,6-benzobisimidazole), poly[2,5(6)-benzimidazole] (AB-PBI), poly[2,6-(1,4-phenylene-4-phenylquinoline], poly[1,1'-(4,4'-biphenylene)-6,6'-bis(4-phenylquinoline)] and the like; polyorganophosphazines such as polyphosphazine, polybisphenoxyphosphazine, poly[bis(2,2,2' trifluoroethylene)phosphazine] and the like; metal polymers such as those derived by condensation of trans-bis(tri-n-butylphosphine)platinum dichloride with a bisacetylene or trans-bis(tri-n-butylphosphine)bis(1,4-butadienyl)platinum and similar combinations in the presence of cuprous iodine and an amide; cellulose and cellulose derivatives such as esters of cellulose as for example triacetate cellulose, acetate cellulose, acetate-butyrate cellulose, nitrate cellulose, and sulfate cellulose, ethers of cellulose as for example, ethyl ether cellulose, hydroxymethyl ether cellulose, hydroxypropyl ether cellulose, carboxymethyl ether cellulose, ethyl hydroxyethyl ether cellulose, cyanoethylethyl ether cellulose, ether-esters of cellulose as for example acetoxyethyl ether cellulose and benzoyloxypropyl ether cellulose, and urethane cellulose as for example phenyl urethane cellulose; thermotropic liquid crystalline polymers such as celluloses and their derivatives as for example hydroxypropyl cellulose, ethyl cellulose propionoxypropyl cellulose; thermotropic copolyesters as for example copolymers of 6-hydroxy-2-naphthoic acid and p-hydroxy benzoic acid, copolymers of 6-hydroxy-2-naphthoic acid, terephthalic acid and p-amino phenol, copolymers of 6-hydroxy-2-naphthoic acid, terephthalic acid and hydroquinone, copolymers of 6-hydroxy-2-naphthoic acid, p-hydroxy benzoic acid, hydroquinone and terephthalic acid, copolymers of 2,6-naphthalene dicarboxylic acid, terephthalic acid, isophthalic acid and hydroquinone, copolymers of 2,6-naphthalene dicarboxylic acid and terephthalic acid, copolymers of p-hydroxybenzoic acid, terephthalic acid and 4,4'-dihydroxydiphenyl, copolymers of p-hydroxybenzoic acid, terephthalic acid, isophthalic acid and 4,4'-dihydroxydiphenyl, p-hydroxybenzoic acid, isophthalic acid, hydroquinone and 4,4'-dihydroxybenzophenone, copolymers of phenylterephthalic acid and hydroquinone, copolymers of chlorohydroquinone, terephthalic acid and p-acetoxy cinnamic acid, copolymers of chlorohydroquinone, terephthalic acid and ethylene dioxy-r,r'-dibenzoic acid, copolymers of hydroquinone, methylhydroquinone, p-hydroxybenzoic acid and isophthalic acid, copolymers of (1-phenylethyl)hydroquinone, terephthalic acid and hydroquinone, and copolymers of poly(ethylene terephthalate) and p-hydroxybenzoic acid; and thermotropic polyamides and thermotropic copoly (amide-esters).

Also illustrative of useful organic filaments are those composed of extended chain polymers formed by polymerization of α,β-unsaturated monomers of the formula:

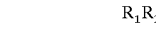

$$R_1R_2—C=CH_2$$

wherein:

$R_1$ and $R_2$ are the same or different and are hydrogen, hydroxy, halogen, alkylcarbonyl, carboxy, alkoxycarbonyl, heterocycle or alkyl or aryl either unsubstituted or substituted with one or more substituents selected from the group consisting of alkoxy, cyano, hydroxy, alkyl and aryl. Illustrative of such polymers of α,β-unsaturated monomers are polymers including polystyrene, polyethylene, polypropylene, poly(1-octadecene), polyisobutylene, poly (1-pentene), poly(2-methylstyrene), poly(4-methylstyrene), poly(1-hexene), poly(4-methoxystyrene), poly(5-methyl-1-hexene), poly(4-methylpentene), poly(1-butene), polyvinyl chloride, polybutylene, polyacrylonitrile, poly(methyl pentene-1), poly(vinyl alcohol), poly(vinyl acetate), poly (vinyl butyral), poly(vinyl chloride), poly(vinylidene chloride), vinyl chloride-vinyl acetate chloride copolymer, poly(vinylidene fluoride), poly(methyl acrylate), poly (methyl methacrylate), poly(methacrylonitrile), poly (acrylamide), poly(vinyl fluoride), poly(vinyl formal), poly (3-methyl-1-butene), poly(4-methyl-1-butene), poly(4-methyl-1-pentene), poly(1-hexane), poly(5-methyl-1-hexene), poly(1-octadecene), poly(vinyl cyclopentane), poly (vinylcyclohexane), poly(a-vinylnaphthalene), poly(vinyl methyl ether), poly(vinylethylether), poly(vinyl propylether), poly(vinyl carbazole), poly(vinyl pyrrolidone), poly(2-chlorostyrene), poly(4-chlorostyrene), poly(vinyl formate), poly(vinyl butyl ether), poly(vinyl octyl ether), poly(vinyl methyl ketone), poly(methylisopropenyl ketone), poly(4-phenylstyrene) and the like.

The most useful high strength fibers include extended chain polyolefin fibers, particularly extended chain polyethylene (ECPE) fibers, aramid fibers, polyvinyl alcohol fibers, polyacrylonitrile fibers, liquid crystal copolyester fibers, polyamide fibers, glass fibers, carbon fibers and/or mixtures thereof. Particularly preferred are the polyolefin and aramid fibers. If a mixture of fibers is used, it is preferred that the fibers be a mixture of at least two of polyethylene fibers, aramid fibers, polyamide fibers, carbon fibers, and glass fibers.

U.S. Pat. No. 4,457,985 generally discusses such extended chain polyethylene and polypropylene fibers, and the disclosure of this patent is hereby incorporated by reference to the extent that it is not inconsistent herewith. In the case of polyethylene, suitable fibers are those of weight average molecular weight of at least 150,000, preferably at least one million and more preferably between two million and five million. Such extended chain polyethylene fibers may be grown in solution as described in U.S. Pat. No. 4,137,394 or U.S. Pat. No. 4,356,138, or may be spun from a solution to form a gel structure, as described in German Off. 3,004,699 and GB 2051667, and especially as described in U.S. Pat. Nos. 4,413,110, 4,551,296, all of which are hereby incorporated by reference. As used herein, the term polyethylene shall mean a predominantly linear polyethylene material that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, colorants and the like which are commonly incorporated by reference. Depending upon the formation technique, the draw ratio and temperatures, and other conditions, a variety of properties can be imparted to these filaments. The tenacity of the filaments is at least about 15 g/d, preferably at least 20 g/d, more preferably at least 25 g/d and most preferably at least 30 g/d. Similarly, the tensile modulus of the filaments, as measured by an Instron tensile testing machine, is at least about 200 g/d, preferably at least 500 g/d, more preferably at least 1,000 g/d, and most preferably at least 1,200 g/d. These highest values for tensile modulus and tenacity are generally obtainable only by employing solution grown or gel filament processes. Many of the filaments have melting points higher than the melting point of the polymer from which they were formed. Thus, for example, high molecular weight polyethylene of 150,000, one million and two million generally have melting points in the bulk of 138° C. The highly oriented polyethylene filaments made of these materials have melting points of from about 7° to about 13° C. higher. Thus, a slight increase in melting point reflects the crystalline perfection and higher crystalline orientation of the filaments as compared to the bulk polymer.

Similarly, highly oriented extended chain polypropylene fibers of weight average molecular weight at least 200,000, preferably at least one million and more preferably at least two million, may be used. Such extended chain polypropylene may be formed into reasonably well oriented filaments by techniques described in the various references referred to above, and especially by the technique of U.S. Pat. Nos. 4,413,110, 4,551,296, 4,663,101, and 4,784,820, hereby incorporated by reference. Since polypropylene is a much less crystalline material than polyethylene and contains pendant methyl groups, tenacity values achievable with polypropylene are generally substantially lower than the corresponding values for polyethylene. Accordingly, a suitable tenacity is at least about 8 g/d, with a preferred tenacity being at least about 11 g/d. The tensile modulus for polypropylene is at least about 160 g/d, preferably at least about 200 g/d. The melting point of the polypropylene is generally raised several degrees by the orientation process, such that the polypropylene filament preferably has a main melting point of at least 168° C., more preferably at least 170° C. The particularly preferred ranges for the above-described parameters can be advantageously provide improved performance in the final article. Employing fibers having a weight average molecular weight of at least about 200,000 coupled with the preferred ranges for the above-described parameters (modulus and tenacity) can provide advantageously improved performance in the final article.

High molecular weight polyvinyl alcohol fibers having high tensile modulus are described in U.S. Pat. No. 4,440,711, which is hereby incorporated by reference to the extent it is not inconsistent herewith. High molecular weight PV—OH fibers should have a weight average molecular weight of at least about 200,000. Particularly useful PV—OH fibers should have a modulus of at least about 300 g/d, a tenacity of at least about 7 g/d (preferably at least about 10 g/d, more preferably about 14 g/d, and most preferably at least about 17 g/d), and an energy-to-break of at least about 8 joules/g. PV—OH fibers having a weight average molecular weight of at least about 200,000, a tenacity of at least about 10 g/d, a modulus of at least about 300 g/d, and an energy to break of about 8 joules/g are likely to be more useful in producing articles of the present invention. PV—OH fibers having such properties can be produced, for example, by the process disclosed in U.S. Pat. No. 4,599,267, hereby incorporated by reference.

In the case of polyacrylonitrile (PAN), PAN fibers for use in the present invention are of molecular weight of at least about 400,000. Particularly useful PAN fiber should have a tenacity of at least about 10 g/d and an energy-to-break of at least about 8 joules/g. PAN fibers having a molecular weight of at least about 400,000, a tenacity of at least about 15 to about 20 g/d and an energy-to-break of at least about 8 joules/g are most useful; such fibers are disclosed, for example, in U.S. Pat. No. 4,535,027, hereby incorporated by reference.

In the case of aramid fibers, suitable aramid fibers formed principally from aromatic polyamide are described in U.S. Pat. No. 3,671,542, hereby incorporated by reference. Preferred aramid fiber will have a tenacity of at least about 20 g/d, a tensile modulus of at least about 400 g/d and an energy-to-break at least about 8 joules/g, and particularly preferred aramid fiber will have a tenacity of at least about 20 g/d, a modulus of at least about 480 g/d and an energy-to-break of at least about 20 joules/g. Most preferred aramid fibers will have a tenacity of at least about 20 g/d, a modulus of at least about 900 g/d and an energy-to-break of at least about 30 joules/g. For example, poly(phenylenediamine terephthalamide) filaments produced commercially by Dupont Corporation under the trade name of KEVLAR® 29, 49, 129 and 149 and having moderately high moduli and tenacity values are particularly useful in forming articles of the present invention. KEVLAR 29 has 500 g/d and 22 g/d and KEVLAR 49 has 1000 g/d and 22 g/d as values of modulus and tenacity, respectively. Also useful in the practice of this invention is poly(metaphenylene isophthalamide) fibers produced commercially by Dupont under the trade name NOMEX®.

In the case of liquid crystal copolyesters, suitable fibers are disclosed, for example, in U.S. Pat. Nos. 3,975,487; 4,118,372; and 4,161,470, hereby incorporated by reference. Tenacities of about 15 to about 30 g/d and preferably about 20 to about 25 g/d, and tensile modulus of about 500 to 1500 g/d and preferably about 1000 to about 1200 g/d are particularly desirable.

If a matrix material is employed in the practice of this invention, it may comprise one or more thermosetting resins, or one or more thermoplastic resins, or a blend of such resins. The choice of a matrix material will depend on how the bands are to be formed and used. The desired rigidity of the band and/or ultimate container will greatly influence choice of matrix material. As used herein "thermoplastic resins" are resins which can be heated and softened, cooled and hardened a number of times without undergoing a basic alteration, and "thermosetting resins" are resins which cannot be resoftened and reworked after molding, extruding or casting and which attain new, irreversible properties when once set at a temperature which is critical to each resin.

The tensile modulus of the matrix material in the band(s) may be low (flexible) or high (rigid), depending upon how the band is to be used. The key requirement of the matrix material is that it be flexible enough to process at whatever stage of the band-forming method it is added. In this regard, thermosetting resins which are fully uncured or have been B-staged but not fully cured would probably process acceptably, as would fully cured thermosetting resins which can be plied together with compatible adhesives. Heat added to the process would permit processing of higher modulus thermoplastic materials which are too rigid to process otherwise, the temperature "seen" by the material and duration of exposure must be such that the material softens for processing without adversely affecting the impregnated fibers, if any.

With the foregoing in mind, thermosetting resins useful in the practice of this invention may include, by way of illustration, bismaleimides, alkyds, acrylics, amino resins, urethanes, unsaturated polyesters, silicones, epoxies, vinylesters and mixtures thereof. Greater detail on useful thermosetting resins may be found in U.S. Pat. No. 5,330,820, hereby incorporated by reference Particularly preferred thermosetting resins are the epoxies, polyesters and vinylesters, with an epoxy being the thermosetting resin of choice.

Thermoplastic resins for use in the practice of this invention may also vary widely. Illustrative of useful thermoplastic resins are polylactones, polyurethanes, polycarbonates, polysulfones, polyether ether ketones, polyamides, polyesters, poly(arylene oxides), poly(arylene sulfides), vinyl polymers, polyacrylics, polyacrylates, polyolefins, ionomers, polyepichlorohydrins, polyetherimides, liquid crystal resins, and elastomers and copolymers and mixtures thereof. Greater detail on useful thermoplastic resins may be found in U.S. Pat. No. 5,330,820, hereby incorporated by reference. Particularly preferred low modulus thermoplastic (elastomeric) resins are described in U.S. Pat. No. 4,820,568, hereby incorporated by reference, in columns 6 and 7, especially those produced commercially by the Shell Chemical Co. which are described in the bulletin "KRATON Thermoplastic Rubber", SC-68-81. Particularly preferred thermoplastic resins are the high density, low density, and linear low density polyethylenes, alone or as blends, as described in U.S. Pat. No. 4,820,458. A broad range of elastomers may be used, including natural rubber, styrene-butadiene copolymers, polyisoprene, polychloroprene-butadiene-acrylonitrile copolymers, ER rubbers, EPDM rubbers, and polybutylenes.

In the preferred embodiments of the invention, the matrix comprises a low modulus polymeric matrix selected from the group consisting of a low density polyethylene; a polyurethane; a flexible epoxy; a filled elastomer vulcanizate; a thermoplastic elastomer; and a modified nylon-6.

The proportion of matrix to filament in the bands is not critical and may vary widely. In general, the matrix material forms from about 10 to about 90% by volume of the fibers, preferably about 10 to 80%, and most preferably about 10 to 30%.

If a matrix resin is used, it may be applied in a variety of ways to the fiber, e.g., encapsulation, impregnation, lamination, extrusion coating, solution coating, solvent coating. Effective techniques for forming coated fibrous layers suitable for use in the present invention are detailed in referenced U.S. Pat. Nos. 4,820,568 and 4,916,000.

This invention is also a method of making at least one blast resistant band which comprises the steps of:

A. wrapping at least one flexible sheet comprising a high strength fiber material around a mandrel in a plurality of layers under tension sufficient to remove voids between successive layers;

B. securing the layers of material together to form a substantially seamless and at least partially rigid first band; and C. removing the band from the mandrel.

The wrapping tension typically is in the range of from about 0.1 to 50 pounds per linear inch, more preferably in the range of from about 2 to 50 pounds per linear inch, most preferably in the range of from about 2 to 20 pounds per linear inch. The fabric layers can be secured in a variety of ways, e.g., by heat and/or pressure bonding, heat shrinking, adhesives, staples, and sewing, as discussed above. It is most preferred that the securing step comprises the steps of contacting the fiber material with a resin matrix and consolidating the layers of high strength fiber material and the resin matrix on the mandrel. The fiber material can be contacted with a resin matrix either before, during or after the wrapping step. Some of the ways in which this can be done are detailed further below. By "consolidating" is meant combining the matrix material and the fiber network into a single unitary layer. Depending upon the type of matrix material and how it is applied to the fibers, consolidation can occur via drying, cooling, pressure or a combination thereof, optionally in combination with application of an adhesive. "Consolidating" is also meant to encompass spot consolidation wherein the faces of a band are consolidated but the edges are not. In this fashion, the faces can be made rigid while the edges retain the ability to bend or be bent to permit collapsing or folding of the band. "Sheet" is meant to include a single fiber or roving for purposes of this invention.

This invention also comprises a method of making a plurality of bands for assembly into a blast resistant container. This method comprises the steps of:

A. wrapping a first flexible sheet of a high strength fiber material around a mandrel in a plurality of layers under sufficient tension to remove voids between successive layers to form a first band;

B. contacting the high strength fiber material of the first flexible sheet with a resin matrix;

C. placing spacing means on the exterior of the first band;

D. wrapping a second flexible sheet of a high strength fiber material around the spacing means in a plurality of layers under sufficient tension to remove voids between successive layers to form a second band;

E. contacting the high strength fiber material of the second flexible sheet with a resin matrix;

F. placing second spacing means on the exterior of the second band;

G. wrapping a third flexible sheet of a high strength fiber material around the second spacing means in a plurality of layers under sufficient tension to remove voids between successive layers to form a third band;

H. contacting the high strength fiber of the third flexible sheet with a resin matrix;

I. repeating the placing, wrapping, and contacting steps to create a desired number of bands;

J. consolidating at least a part of each of the bands on the mandrel; and

K. removing the bands and spacing means from the mandrel.

This method allows formation of all of the bands for a single container at one time.

In one preferred embodiment, the flexible sheet material is formed as follows. Yarn bundles of from about 30 to about 2000 individual filaments of less than about 12 denier, and more preferably of about 100 individual filaments of less than about 7 denier, are supplied from a creel, and are led through guides and a spreader bar into a collimating comb just prior to coating. The collimating comb aligns the filaments coplanarly and in a substantially parallel, and unidirectional fashion. The filaments are then sandwiched between release papers, one of which is coated with a wet matrix resin. This system is then passed under a series of pressure rolls to complete the impregnation of the filaments. The top release paper is pulled off and rolled up on a take-up reel while the impregnated network of filaments proceeds through a heated tunnel oven to remove solvent and then be taken up. Alternatively, a single release paper coated with the wet matrix resin can be used to create the impregnated network of filaments. One such impregnated network forms the feed material for making mini-bands as depicted in FIG. 16 and detailed in Example 9 below.

In the most preferred embodiment of this invention, two such impregnated networks are then continuously cross plied, preferably by cutting one of the networks into lengths that can be placed successively across the width of the other network in a 0°/90° orientation. This forms a continuous flexible sheet of high strength fiber material. See U.S. Pat. No. 5,173,138, hereby incorporated by reference. This flexible sheet (fibrous layer), optionally with film as discussed below, can then be used to form one or more bands in accordance with the methods of the present invention. This fibrous layer is sufficiently flexible to wrap in accordance with the methods of the present invention; it can then be made substantially rigid (per the drapability test), if desired, either by the sheer number of wraps or by the manner in which it is secured. The weight percent of fiber in the hoop direction of the band can be varied by varying the number and the orientation of the networks (see the examples which follow).

In another embodiment, one or more uncured thermosetting resin-impregnated networks of high strength filaments are similarly formed into a flexible sheet for winding around the mandrel into a band or bands in accordance with the present invention followed by curing (or spot curing) of the resin.

Film may optionally be used as one or more layers of the band(s), preferably as an outer layer. The film, or films, can be added as the matrix material (lamination), with the matrix material or after the matrix material, as the case may be. When the film is added as the matrix material, it is preferably simultaneously wound with the fiber or fabric (network) onto a mandrel and subsequently consolidated; the mandrel may optionally become part of the structure. The film thickness minimally is about 0.1 mil and may be as large as desired so long as the length is still sufficiently flexible to permit band formation. The preferred film thickness ranges from 0.1 to 50 mil, with 0.35 to 10 mil being most preferred. Films can also be used on the surfaces of the bands for a variety of reasons, e.g., to vary frictional properties, to increase flame retardance, to increase chemical resistance, to increase resistance to radiation degradation, and/or to prevent diffusion of material into the matrix. The film may or may not adhere to the band depending on the choice of film, resin and filament. Heat and/or pressure may cause the desired adherence, or it may be necessary to use an adhesive which is heat or pressure sensitive between the film and the band to cause the desired adherence. Examples of acceptable adhesives include polystyrene-polyisoprene-polystyrene block copolymer, thermoplastic elastomers, thermoplastic and thermosetting polyurethanes, thermoplastic and thermosetting polysulfides, and typical hot melt adhesives.

Films which may be used as matrix materials in the present invention include thermoplastic polyolefinic films, thermoplastic elastomeric films, crosslinked thermoplastic films, crosslinked elastomeric films, polyester films, polyamide films, fluorocarbon films, urethane films, polyvinylidene chloride films, polyvinyl chloride films and multilayer films. Homopolymers or copolymers of these films can be used, and the films may be unoriented, uniaxially oriented or biaxially oriented. The films may include pigments or plasticizers.

Useful thermoplastic polyolefinic films include those of low density polyethylene, high density polyethylene, linear low density polyethylene, polybutylene, and copolymers of ethylene and propylene which are crystalline. Polyester films which may be used include those of polyethylene terephthalate and polybutylene terephthalate.

Pressure can be applied by an interleaf material made from a plastic film wrap which shrinks when the band is exposed to heat; acceptable materials for this application, by way of example, are polyethylene, polyvinyl chloride and ethylene-vinylacetate copolymers.

The temperatures and/or pressures to which the bands of the present invention are exposed to cure the thermosetting resin or to cause adherence of the networks to each other and optionally, to at least one sheet of film, vary depending upon the particular system used. For example, for extended chain polyethylene filaments, temperatures range from about 20° C. to about 150° C., preferably from about 50° C. to about 145° C., more preferably from about 80° C. to about 120° C., depending on the type of matrix material selected. The pressures may range from about 10 psi (69 kPa) to about 10,000 psi (69,000 kPa). A pressure between about 10 psi (69 kPa) and about 500 psi (3450 kPa), when combined with temperatures below about 100° C. for a period of time less than about 1.0 min., may be used simply to cause adjacent filaments to stick together. Pressures from about 100 psi (690 kPa) to about 10,000 psi (69,000 kPa), when coupled with temperatures in the range of about 100° C. to about 155° C. for a time of between about 1 to about 5 min., may cause the filaments to deform and to compress together (generally in a film-like shape). Pressures from about 100 psi (690 kPa) to about 10,000 psi (69,000 kPa), when coupled with temperatures in the range of about 150° C. to about 155° C. for a time of between 1 to 5 min., may cause the film to become translucent or transparent. For polypropylene filaments, the upper limitation of the temperature range would be about 10 to about 20° C. higher than for ECPE filament. For aramid filaments, especially Kevlar filaments, the temperature range would be about 149 to 205° C. (about 300 to 400° F.).

Pressure may be applied to the bands on the mandrel in a variety of ways. Shrink wrapping with plastic film wrap is mentioned above. Autoclaving is another way of applying pressure, in this case simultaneous with the application of heat. The exterior of each band may be wrapped with a shrink wrappable material and then exposed to temperatures which will shrink wrap the material and thus apply pressure to the band. The band can be shrink wrapped on the mandrel in its hoop direction which will consolidate the entire band, or the band can be shrink wrapped across its faces with material placed around the band wrapped mandrel perpendicular to the hoop direction of the band; in the latter case, the edges of the band can remain unconsolidated while the faces are consolidated.

Many of the bands formed with fibrous layers utilizing elastomeric resin systems, thermosetting resin systems, or resin systems wherein a thermoplastic resin is combined with an elastomeric or thermosetting resin can be treated with pressure alone to consolidate the band. This is the preferred way of consolidating the band. However, many of the bands formed with continuous lengths/plies utilizing thermoplastic resin systems can be treated with heat, alone or combined with pressure, to consolidate the band.

In the most preferred embodiments, each fibrous layer has an areal density of from about 0.1 to about 0.15 kg/m$^2$. The areal density per band ranges from about 1 to about 40 kg/m$^2$, preferably from about 2 to 20 kg/m$^2$, and more preferably from about 4 to about 10 kg/m$^2$. In the most preferred embodiments, where SPECTRA SHIELD® composite nonwoven fabric forms a fibrous layer, these areal densities correspond to a number of fibrous layers per band ranging from about 10 to about 400, preferably from about 20 to about 200, more preferably from about 40 to about 100. In the three band cube design of the most preferred embodiment of the present invention, each face of the cube comprises two bands of blast resistant material, which effectively doubles the aforesaid ranges for each face of the cube. Where fibers other than high strength extended chain polyethylene, like SPECTRA® polyethylene fibers, are utilized the number of layers may need to be increased to achieve the high strength and modulus characteristics provided by the preferred embodiments.

The following examples are presented to provide a more complete understanding of the invention and are not to be construed as limitations thereon. In the examples, the following technical terms are used:

(a) "Areal Density" is the weight of a structure per unit area of the structure in kg/m$^2$. Panel areal density is determined by dividing the weight of the panel by the area of the panel. For a band having a polygonal cross-sectional area, areal density of each face is given by the weight of the face divided by the surface area of the face. In most cases, the areal density of all faces is the same, and one can refer to the areal density of the structure. However in some cases the areal density of the different faces is different. For a band having a circular cross-sectional area, areal density is determined by dividing the weight of the band by the exterior surface area of the band. For a cubic box container, the areal density is the areal density of each of the six panels forming the faces of the box and does not include the areal density of any hinges or pins.

(B) "Fiber Areal Density of a Composite" corresponds to the weight of the fiber reinforcement per unit area of the composite.

(c) "$C_{50}$", a measure of blast resistance, is measured as the level of charge (in ounces) that will rupture the container/tube 50% of the time (where $C_0$ represents no failures/ruptures and $C_{100}$ represents failure 100% of the time). If failure occurs at one level and not at the next lower level, the $C_{50}$ is calculated by averaging the two levels.

In these examples, unless otherwise indicated, the explosive used was TRENCHRITE 5, a product of Explosives Technologies International and a class A explosive having a shock wave velocity of 16,700 ft/sec. Also, for the boxes and tubes where high speed video results are reported, the video camera utilized to record the explosive events was a vhs video, Sylvania Model VCC 159 AV01. The camera was remotely operated and was located so that the subject box or tube filled approximately 30% of the viewing area.

The specific techniques, conditions, materials, proportions and reported data set forth to illustrate the principles of the invention are exemplary and should not be construed as limiting the scope of the invention.

EXAMPLE 1 (COMPARATIVE)

Three cubic boxes were constructed for testing, two utilizing SPECTRA SHIELD® composite panels for their faces and one utilizing KEVLAR® composite panels for its faces.

The box made from SPECTRA SHIELD composite was constructed (31 inches on a side) utilizing six flat SPECTRA SHIELD® composite panels as its faces, each 27 inches square, hinged together with two sets of hinges and two pins per edge (total of 24 pins and hinges). The panels, having an overall areal density of 1.14 lb/ft$^2$, were constructed in the following manner.

Figure 17:
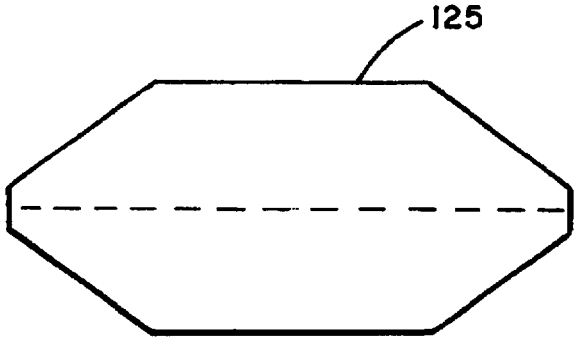
FIG. 17 is a plan view of a pattern utilized in Example 1.
Figure 18:
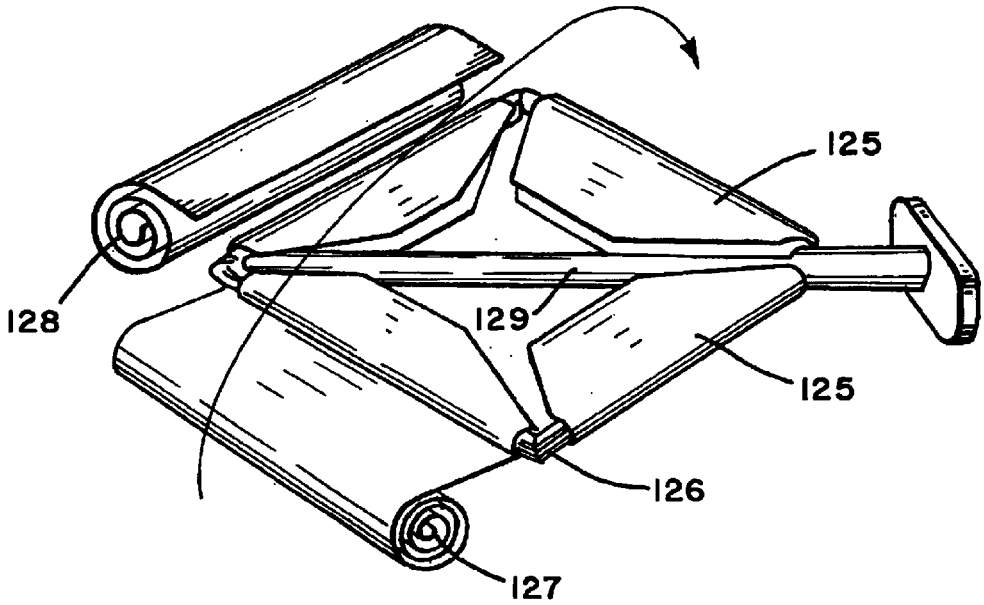
FIG. 18 is a three dimensional view of a portion of a stack/winder machine.

Fabric shapes 125, shown in FIG. 17, were partially wrapped around the perimeter rods 126 of an aluminum frame as shown in FIG. 18. The wrapping (bending) occurred along the dotted line FIG. 17) having an overall length of 27.25". Three fabric layers (shapes) were wrapped on each of the four perimeter rods 126. These fabric shapes 125 consisted of SPECTRA 1000 fabric, Style 904 (plain weave, 34×34 ends per inch, 650 denier SPECTRA 1000 yarn weighing 6 oz/yd$^2$). The fabrics were impregnated with a sufficient amount of Dow XU71943.00L experimental vinyl ester resin (diallyl phthalate—6 wt. %, methyl ethyl ketone—31 wt. %, and vinyl ester resin—63 wt. %) to produce an impregnated fabric having 80 wt. % SPECTRA 1000 and 20 wt. % resin. In all cases the resin contained 1.0 wt. % Lupersol 256, a product of the Lucidol Division of Ato Chem Corporation [2,5-dimethyl-2,5-bis(2-ethylhexanoylperoxy)hexane].

The aluminum frame was also used to wrap the square composite panels. Two rolls 127 and 128 of unidirectional prepreg tape were positioned to adjacent sides of the frame for wrapping alternatively around the frame to achieve a 0°/90°/0°/90°/etc. laydown of prepreg. The process was repeated until the desired areal density was attained. Each prepreg tape contained 7.6 ends per linear inch of 1500 denier SPECTRA 1000 yarn in Dow Resin XU71943.00L experimental vinyl ester resin, described above. The methyl ethyl ketone volatizes before the composite is cured. The prepreg was 76 wt. % SPECTRA 1000 fiber and 24 wt. % resin.

After wrapping was complete, the diagonal bar 129 of the aluminum frame was removed, and the central area (27×27 inches) was molded at 120° C. for 30 minutes under a force of 150 tons. The perimeter aluminum rods 126 were then removed, which left perimeter loops. The perimeter loops were then cut at intervals of 3 inches.

The cubic box container was assembled with one inch diameter cold rolled steel pins. One half of the perimeter loops were folded to be on the outside of the container and one half of the perimeter loops were folded to be on the inside of the container. There were 9 loops per edge, alternated inside and outside. Pins were placed in both the inside and outside loops, two per edge.

The box made from KEVLAR composite was constructed in a similar manner, except that KEVLAR 29 fabric (Style 423-2×2 basket weave of 1500 denier yarn, 14 oz/yd$^2$) was utilized, and only one layer of the fabric was wrapped around each perimeter rod. The panel overall areal density was the same as the SPECTRA SHIELD panel, i.e., 1.14 lb/ft$^2$.

The first two boxes made from SPECTRA SHIELD composite panels were tested using 8 and 16 ounces of explosive charges, respectively, placed at their respective geometric centers. The box was found to withstand the blast from the 8 ounce explosion; however, considerable rapid venting occurred at the edges and corners of the box. The 16 ounce charge blew the container apart, and the steel hinge pins became dangerous projectiles.

The third box made from KEVLAR composite panels was tested using an 8 ounce explosive charge placed at its geometric center. The explosion caused massive rupture of the container, and the steel hinge pins became dangerous projectiles.

EXAMPLE 2

A SPECTRA SHIELD® PCR composite roll, commercially available from AlliedSignal, Inc., was cut into four 15 inch wide strips, each approximately 330 inches in length. The SPECTRA SHIELD® PCR composite contained 80 weight percent SPECTRA® 1000 extended chain polyethylene fiber (nominal tenacity of about 35 g/d, tensile modulus of about 1150 g/d, and elongation-to-break of about 3.4%, also available from AlliedSignal, Inc.) in a 20 weight percent resin matrix of polystyrene-polyisoprene-polystyrene block copolymer, available from Shell Co. under the tradename KRATON® D1107. The SPECTRA fibers were arranged in the composite in a 0°/90° configuration. Each strip was wrapped in successive layers around a square cross-sectional mandrel having a side length of 15 inches to form a band having 22 wraps of SPECTRA SHIELD (see FIG. 14B). The wrapping of each successive strip was started at the point where the prior strip ended, with the identical fiber configuration and under sufficient tension (about 1 lb per linear inch) to minimize voids in successive wraps. An adhesive solution consisting of 5 g of KRATON D1107 per 95 g of toluene was painted onto the exterior of the strips during wrapping to provide adhesive material between successive wraps. A conventional rolling pin was used to consolidate the successive wraps during band formation to minimize voids in successive wraps.

After the first band had been completed, four 15 inch×20 inch aluminum plates, each 0.125 inch thick and wrapped in TEFLON®-coated glass fabric, were affixed to the exterior of the band, one plate per face of the band, with the 15 inch side corresponding to the 15 inch side length of the mandrel. Masking tape was wrapped around the four aluminum plates to hold them in place, with a central area left without tape for wrapping the second band. A second band was formed by wrapping SPECTRA SHIELD PCR composite strips in a manner identical to that used for the first band. A second set of four aluminum plates were affixed to the faces of the second band followed by construction of a third band in the same manner as the first and second bands. The three bands were removed from the mandrel, and the toluene evaporated from the bands. In each band, 50 weight percent of the fiber was continuous and oriented in the hoop direction of the band.

The three bands were nested together as shown in FIG. 1F to create a Box 1 for evaluation against an explosive charge. Each side of the box corresponds to 44 wraps of 0°/90° SPECTRA SHIELD PCR since there are faces of two bands covering each side of the box, and each band face comprises 22 wraps. The areal density of Box 1=0,13×44=5.72 kg/m$^2$ or 1.17 lb/ft$^2$. The weight of the Box 1 was 5.8 kg (12.6 lb).

Box 2 was constructed in the same manner as Box 1 with the following modifications. The first two strips of SPECTRA SHIELD composite used in constructing the first band were 24 inches wide. After removal of the band and evaporation of the toluene, the first band was cut into a distance of 4.5 inches from either side at each corner to allow for eight flaps (four on each side of the 15 inch wide band, two per face) of 4.5 inch width to be created. The flaps were made by folding the cut portion of the strip along the band width line. The plane of each flap was perpendicular to the plane of the side of the band to which it was attached. See FIG. 3B. These flaps were held in place by the second and third bands. Weight of Box 2 was 6.08 kg (13.4 lb). The areal density of the faces was identical to Box 1, and the increase in weight was due to the flaps.

Boxes 3 and 4 were prepared in an identical manner to Box 2, and were essentially identical in weight and areal density.

Box 1 was tested using a 16 ounce explosive charge at its geometric center. During detonation, the edges of all three bands were completely or almost completely destroyed to result in a number of 15 inch square pieces, which were still intact and showed little damage.

Box 2 was tested using an 8 ounce charge in a manner identical to testing of Box 1. High speed video showed initial charge containment followed by distortion and breakage of band 3 at two opposite edges (broken band 3 consisted of two identical halves). Extensive gas venting occurred. Bands 1 and 2 remained essentially intact.

Box 3 was tested using a 2 ounce charge in a manner identical to testing of Box 1. High speed video showed minor gas venting during the detonation and bulging of the sides. However, the box remained intact. All three bands were undamaged.

Box 4 was tested using a 4 ounce charge. High speed video showed more extensive venting and distortion of band 1 compared with Box 3. All three bands remained intact with no significant breakage.

EXAMPLE 3

A box was constructed in the same manner as Box 2 of Example 2 above, with the following changes. The mandrel was modified so that the edges were round, having a radius of ⅝ inch. The areal density of the bands was one-half that of Box 2. The flap width on Band 1, the inner band, was increased to 6 inches. Band was reinforced to control deformation and the rate of escape of gases from the explosion. This reinforcement consisted of first wrapping the mandrel in two complete wraps of 15 inch wide S-2 glass cloth (Style 6781, areal density 0.309 kg/m$^2$, manufactured by Clark Schwebel). This glass cloth was impregnated with EPON 828 epoxy resin, commercially available from the Shell Co., by using 8 pph Millamine, a cycloaliphatic diamine, available from Milliken Chemical Co., as a room temperature curing agent. The glass/resin ratio was 48/52 by weight. The SPECTRA SHIELD composite strips for Band 1 were then wound on top of the glass fabric, which became an integral part of Band 1.

To provide additional reinforcement, a panel of glass/epoxy composite, commercially available from 3M Corporation as Scotch Ply Type 1002, was attached to each of the four inside surfaces of the glass fabric band (Band 1). Each panel measured about 13.5×14.5 inches, weighed 340 g and was 56 mil thick. The panels were attached with a total of 200 g of a polysulfide adhesive PROSEAL 890-B1/2, manufactured by Courtaulds Aerospace Company. The inside surfaces of the 8 flaps were also reinforced by attaching to each a 3.75×13.75 inches piece of the glass/epoxy panel using Scotch 410 Flat Stock linear double coated paper tape, available from 3M Corporation. The total weight of these 8 pieces of panel was 707 g. The assembled box weighed 6.17 kg (13.6 lb), consisting of 3.04 kg (6.7 lb) SPECTRA SHIELD composite and 3.13 kg (6.9 lb) fiber glass composite and adhesives.

This box was tested using a 6 ounce charge of TRENCHRITE 5 in a manner identical to testing of Boxes in Example 2. The container contained the charge with minimum distortion, no rapid venting and essentially no visible permanent damage to the structure.

EXAMPLE 4

A box was constructed like Box 2 of Example 2 with the following modifications. In Band 1, the first half of the composite strip length was 21 inches wide while the second half was 15 inches wide. This permitted eight flaps to be created, four per side of the band, each 3 inches by 15 inches and having an areal density 4.75 kg/m$^2$. Band 1 consisted of 70 SPECTRA SHIELD composite wraps and had an areal density of 9.5 kg/m$^2$. An 0.125 inch wide aluminum plate was placed around Band 1. Band 2 was formed by wrapping strips that were 17 inches wide around the spacer. A second spacer of 0.125 inch width was placed around Band 2 and Band 3 was formed by wrapping strips that were 18 inches wide. The three bands were removed from the mandrel and from the spacers. In each band, about 50 weight percent of the fiber was continuous and oriented in the hoop direction.

Four 14 inch square fiberglass plates, commercially available from 3M Corporation as Scotch Ply Type 1002, and having an areal density of 2.7 kg/m$^2$, were glued to the inside faces of Band 1 using a total of about 128 g (32 g/face) of a polysulfide adhesive PROSEAL 890-B 1/2, manufactured by Courtaulds Aerospace Company.

The three bands were assembled with Band 1 nesting inside of Band 2 which nested inside of Band 3, with two band faces per side. The flaps of Band 1 were held in place by Bands 2 and 3. The completed container had a side length of approximately 18 inches and weighed 24.06 kg (53 lb).

An M67 fragmentation hand grenade was modified so that it could be detonated electronically. The M67 grenade weighed 14 ounces and incorporated 6.5 ounces of compound B explosive. For greater detail on this standard hand grenade, reference may be had to *Guide Book for Marines,* 15th Revised Edition, Quantico, Va., p. 352, Sep. 01, 1986, hereby incorporated by reference. The grenade was placed in the geometrical center of the container and detonated. The container maintained its shape and the integrity of the individual bands. The container was disassembled and examined. The number of perforations in the four inner fiberglass panels of Band 1 indicated that more than 1200 steel projectiles were generated by the exploding grenade. Examination of the outer faces of the container indicated that 21 penetrations occurred.

The results of this test demonstrated that the basic containment concept was sound and can protect against a combination of projectiles and blast.

EXAMPLE 5

A series of four identical tubes, 27 inches long and open at both ends, was prepared by wrapping SPECTRA SHIELD PCR composite around the mandrel having rounded edges described in Example 3. These tubes were substantially square in cross-section, and had a side length of 15 inches. The strip was 27 inches wide and a sufficient number of wraps were made to create a tube with a wall areal density of 2.86 kg/m$^2$ (0.585 lb/ft$^2$). The areal density of the individual tubes is identical to the areal density of the individual bands for Boxes 1–4 of Example 2. With this construction, about 50 weight % of the fibers are continuous lengths in the hoop or band direction, i.e., encircling the tube. In all other respects, the construction of the tube was identical to wrapping of the first band for Box 1 in Example 2.

These tubes were evaluated as follows. A charge was placed at the geometric center of each of the four tubes, A, B, C, and D, and electronically detonated. The weight of the charge was varied, as reported in Table 1, where results are set forth. An estimate of the $C_{50}$ value for the tube design is set forth in Table 2.

EXAMPLE 6

A second series of four identical tubes was prepared as in Example 5, except that two layers of continuous unidirectional tape were affixed to either side of the conventional 0°/90° SPECTRA SHIELD PCR composite strip to create a composite strip having a 0°/0°/90°/0° fiber configuration with the 0° designation indicating continuous fiber lengths in the hoop or band direction. The continuous unidirectional tape was identical to tape that was cross-plied to construct the conventional SPECTRA SHIELD PCR, as described in greater detail in Example 2. With this configuration, about 75 weight % of the fibers are continuous length fibers in the hoop or band direction, i.e., encircling the tube. All other parameters were identical to Example 5.

These tubes were tested in the same fashion as those of Example 5. Data is set forth in Table 1 and an estimate of $C_{50}$ is set forth in Table 2.

EXAMPLE 7

A third series of four identical tubes was prepared as in Example 5 except these tubes were circular in cross-sectional area due to wrapping of the composite strip about a round mandrel 16.375 inches in diameter. The cross-sectional area of these tubes was identical to that of the tubes in Examples 5 and 6. About 50 weight % of the fibers are continuous length fibers in the hoop or band direction, i.e., encircling the tube.

These tubes were tested in the same fashion as those of Example 5. Data is set forth in Table 1 and an estimate of $C_{50}$ is set forth in Table 2.

EXAMPLE 8

Four more series of four identical tubes each were prepared for testing. In all of the series the tubes were substantially square in cross-section, had a side length of 7.5 inches, and were open at both ends.

In the first and second series, the tubes had overall tube lengths of 15 and 22.5 inches, respectively, and were prepared in the following manner. SPECTRA SHIELD PCR composite strip of the specified width (15 or 22.5 inches) was wrapped around the mandrel having rounded edges described in Example 3. A sufficient number of wraps were made to create a tube with a wall areal density of 2.86 kg/m$^2$. In all other respects, the construction of the tube was identical to wrapping of the band for Box 1 in Example 2, i.e., the KRATON adhesive solution was utilized and the successive wraps were consolidated.

In the third and fourth series, the tubes had overall tube lengths of 15 and 22.5 inches, respectively, and were prepared in the following manner. SPECTRA SHIELD PCR composite strip of the specified width (15 or 22.5 inches) was wrapped around the mandrel having rounded edges described in Example 3. A sufficient number of wraps were made to create a tube having a wall areal density of 2.86 kg/m$^2$. No adhesive was used although the success wraps were consolidated using a conventional rolling pin. The wrapped band/tube was placed between the platens of a hydraulic press under low pressure and molded at 120° C. for 15 minutes. Since the edges of the mandrel were rounded, the SPECTRA SHIELD layers were not fully consolidated along the edges.

These tubes were evaluated as follows. A charge was placed at the geometric center of each of the tubes and electronically detonated. The initial explosive charge evaluated was 1.5 ounces, which all of the four different tube types withstood. With an explosive charge of 2 ounces, however, all of the four different tube types ruptured. The calculated $C_{50}$ so for the four different tube constructions, therefore, is 1.75 ounces. Data is set forth in Table 3.

EXAMPLE 9

Tubes identical to those described in Example 6 are constructed. In addition, five one-inch wide bands of unidirectional SPECTRA prepreg (identical to the unidirectional prepreg added to the 0°/90° SPECTRA SHIELD PCR in Example 6) are wound in the hoop direction at 4 inch intervals on each tube, as shown in FIG. 16. Either adhesives or heat and pressure may be used to consolidate the unidirectional bands, preferably the latter. Temperature of about 120° C. and pressure of about 5 psi for about 30 minutes is suitable. The areal density of these bands is 50% of the areal density of the tube. Because they cover 20% of the tube area, these bands will add 10% to the weight of the tube. When these tubes are evaluated in a manner comparable to the tubes of Examples 5 and 6, it is anticipated that the bands will limit the length of tears to 4 inches and will control the rate of gas loss through such tears.

Discussion

The examples demonstrate that cubic containers constructed from three mutually supporting four-sided bands provide outstanding blast resistance. Example 2's Box 2 of side length 15 inches was able to contain almost as large an explosive charge as the control cubic container of Example 1 of side length 31 inches and having almost an identical areal density (made utilizing SPECTRA SHIELD composite panels). Thus, similar performance is obtained using a box significantly lighter and smaller than that of the control, i.e., 114 the weight of the control and containing ⅛ the volume. In addition, the boxes designed in accordance with the present invention are much easier to open and close and do not have steel hinge pins which can act as long rod penetrators during an explosive event. It is interesting to note that the box of the comparative example utilizing SPECTRA SHIELD composite panels outperformed the box utilizing KEVLAR composite panels.

Examination of the boxes of Example 2 after explosive testing, coupled with evaluation of high speed photography results, indicated that container failure did not occur by "shock holing" (rupture caused by the impulse of the shock wave against the container wall). Shock holing would have caused rupture of the containers at the center of the faces of the cube. In no case was this observed, failure occurred along the edges of the boxes. During the explosive event, the bands of theses boxes distorted and allowed venting of gases. The flaps of the flapped boxes helped to control, but did not eliminate, the venting of hot gases. In order to further reduce such venting the inner band was made more rigid in Example 3 by incorporating a rigid epoxy inner shell. This container easily contained 6 ounces of explosive, with minimum distortion, no rapid venting and essentially no visible permanent damage to the structure.

With reference to Examples 5–7 and Tables 1 and 2, it can be seen that failure of the square cross-sectional tubes occurred by breaking fibers along the length of the edges. These tears were oriented in parallel to the length of the tubes, which is essentially perpendicular to the hoop direction of the tube. By increasing the fraction of substantially continuous fiber in the hoop direction of the tube (Example 5 vs. Example 6) the ballistic performance of the tube was increased. A fiber fraction increase of 50% resulted in a 50% increase in the $C_{50}$ value.

The results set forth in Tables 1 and 2 also clearly show that the square cross-sectional tube was more blast resistant than the circular cross-sectional tube. The square cross-sectional tube distorted to a more nearly circular cross-sectional shape, which resulted in an increase in cross-sectional area, and thus an increase in internal volume of the tube by as much as 30%. It is believed that this effectively lowered the strain rate to which the fibers were subjected, and that this response decreased the rate of the application of high tensile force and decreased its magnitude.

With reference to Table 3 and the data set forth regarding square cross-sectional tubes, it can be seen that less damage occurred with shorter overall tube lengths and when the SPECTRA SHIELD fibrous layers were consolidated using heat and pressure rather than an adhesive solution.

In all of the tubes, the tear direction was parallel to the length of the tubes. Consequently, in Example 9, the tear length is limited by wrapping the tubes in the hoop direction with bands of a reinforcing unidirectional strip (mini-bands). Limiting the length of the tears that form is expected to limit the rate of gas escape to thereby make tubes and containers constructed according to this principle more resistant to catastrophic failure.

From the foregoing description, one skilled in the art can easily ascertain the essential characteristics of this invention, and without departing from the spirit and scope thereof, can make various changes and modifications of the invention to adapt it to various usages and conditions.

TABLE 1

Blast Data for Tubes

| Example | Tube | Charge (oz) | Results* |
|---|---|---|---|
| 5 | A | 8 | one failure, 6" tear on edge |
| 5 | B | 4 | no failures |
| 5 | C | 6 | one failure, 3" tear on edge |
| 5 | D | 6 | no failures |
| 6 | A | 9 | no failures |
| 6 | B | 13 | two failures, 11" tear on edge and 12" tear on edge |
| 6 | C | 11 | two failures, 6" tear on edge and 4" tear on edge |
| 6 | D | 10 | one failure, 6" tear on edge |
| 7 | A | 12 | six failures, tears of 22", 20", 8", 8", 22" and 5" |
| 7 | B | 8 | six failures, tears of 1", 3.5", 1.5", 15", 3", 13" |
| 7 | C | 4 | one failure, 2.5" tear |
| 7 | D | 2 | no failures |

*All tears were oriented in parallel to the length of the tubes.

TABLE 2

Comparison of Blast Resistance of Different Tubes

| Example | Cross-Sectional Shape | Fraction Continuous Fibers Hoop Direction | $C_{50}$ (oz.) |
|---|---|---|---|
| 5 | Square | 0.50 | 6.0 |
| 6 | Square | 0.75 | 9.5 |
| 7 | Circular | 0.50 | 3.0 |

TABLE 3

Example 8 Tube Blast Data for 2 Ounce Charge

| Series | Tube Length (inches) | Results* |
|---|---|---|
| 1 (adhesive) | 15 | one failure, 4" tear on edge |
| 2 (adhesive) | 22.5 | two failures, 3.5" tear on edge and 1.75" tear on edge |
| 3 (pressed) | 15 | one failure, 2.5" tear on edge |
| 4 (pressed) | 22.5 | one failure, 3.75" tear on edge |

*All tears were oriented in parallel to the length of the tubes.

We Claim:

1. A blast resistant container comprising at least three bands of a material, a first inner band being nested within a second band which is nested within a third band, said bands being oriented relative to one another to substantially enclose a volume and to form a container wall having a thickness substantially equivalent to the sum of the thicknesses of at least two of the bands, the outermost band being substantially seamless and blast resistant, wherein each edge of the container is covered by at least one of said bands.

2. The container of claim 1 wherein each of said first, second, and third bands is a tube having a longitudinal axis, and wherein the longitudinal axes of said first, second, and third bands are substantially perpendicular to one another.

3. The container of claim 2 wherein each of the bands is substantially polygonal in cross-section.

4. The container of claim 3 wherein at least one of said bands comprises a plurality of substantially rectangular surfaces in series, said surfaces numbering at least one more than the number of sides of the polygon of the cross-section of the band, and wherein said band comprising said surfaces is nested within another said band.

5. The container of claim 3 wherein each of the bands is substantially rectangular in cross-section to thereby substantially form a rectangular prism.

6. The container of claim 5 wherein each of the bands is substantially square in cross-section to thereby substantially form a cube.

7. The container of claim 1 wherein a rigid support structure is nested within said first inner band.

8. The container of claim 7 wherein said rigid support structure comprises a low density, lightweight polymeric or metallic band.

9. The container of claim 7 wherein said first inner band is affixed to said rigid support structure.

10. The container of claim 1 wherein the band material comprises at least one fibrous layer, said fibrous layer comprising at least one network of fibers, at least about 10 weight percent of said fibers being substantially continuous lengths of fiber that encircle the enclosed volume.

11. The container of claim 10 wherein said fiber comprises a high strength fiber having a tenacity of at least about 10 g/d and a tensile modulus of at least about 200 g/d.

12. The container of claim 11 wherein said high strength fibers are selected from the group consisting of extended chain polyolefin fibers, aramid fibers, polyvinyl alcohol fibers, polyacrylonitrile fibers, liquid copolyester fibers, polyamide fibers, glass fibers, carbon fibers, and mixtures thereof.

13. The container of claim 11 wherein said fibers are polyolefin fibers.

14. The container of claim 11 wherein said fibers are aramid fibers.

15. The container of claim 11 wherein said fibers are a mixture of at least two of polyethylene fibers, aramid fibers, polyamide fibers, carbon fibers and glass fibers.

16. The container of claim 11 wherein the network of fibers is in a resin matrix.

17. The container of claim 16 wherein the matrix comprises a low modulus polymeric matrix selected from the group consisting of a low density polyethylene; a polyurethane; a flexible epoxy; a filled elastomer vulcanizate; a thermoplastic elastomer; and a modified nylon 6.

18. The container of claim 16 wherein said fiber comprises a high strength fiber having a tenacity of at least about 10 g/d and a tensile modulus of at least about 200 g/d.

19. The container of claim 18 wherein each of the bands is substantially polygonal in cross-section and deforms to increase the enclosed volume during an explosion.

20. The container of claim 16 wherein at least about 50 weight percent of said fibers are substantially continuous lengths of fiber that encircle the enclosed volume, and wherein said bands are substantially seamless.

21. The container of claim 20 wherein at least about 75 weight percent of said fibers are substantially continuous lengths of fiber that encircle the enclosed volume.

22. The container of claim 10 wherein at least about 50 weight percent of said fibers are substantially continuous lengths of fiber that encircle the enclosed volume, and wherein said bands are substantially seamless.

23. The container of claim 22 wherein at least about 75 weight percent of said fibers are substantially continuous lengths of fiber that encircle the enclosed volume.

24. The container of claim 23 wherein said fiber comprises a high strength fiber having a tenacity of at least about 10 g/d and a tensile modulus of at least about 200 g/d.

25. The container of claim 24 wherein said high strength fibers are selected from the group consisting of extended chain polyolefin fibers, aramid fibers, polyvinyl alcohol fibers, polyacrylonitrile fibers, liquid copolyester fibers, polyamide fibers, glass fibers, carbon fibers, and mixtures thereof.

26. The container of claim 24 wherein said fibers are polyolefin fibers.

27. The container of claim 24 wherein said fibers are aramid fibers.

28. The container of claim 24 wherein said fibers are a mixture of at least two of polyethylene fibers, aramid fibers, polyamide fibers, carbon fibers and glass fibers.

29. The container of claim 1 wherein said band material comprises an oriented film selected from the group consisting of homopolymers and copolymers of thermoplastic polyolefins, thermoplastic elastomers, crosslinked thermoplastics, crosslinked elastomers, polyesters, polyamides, fluorocarbons, urethanes, epoxies, polyvinylidene chloride, polyvinyl chloride, and blends thereof.

30. The container of claim 29 wherein said band material further comprises a network of fibers, at least about 10 weight percent of said fibers being substantially continuous lengths of high strength fiber that encircle the enclosed volume, said high strength fiber having a tenacity of at least about 10 g/d and a tensile modulus of at least about 200 g/d.

31. A blast resistant container comprising a rigid support structure and at least three bands of a material, a first inner band being nested within a second band which is nested within a third band, said bands being oriented relative to one another to substantially enclose a volume and to form a container wall having a thickness substantially equivalent to the sum of the thicknesses of at least two of the bands, the outermost band being substantially seamless and blast resistant, said rigid support structure comprising a low density, lightweight polymeric or metallic band nested within said first inner band and wrapped with glass or carbon fibers.

32. A blast resistant container comprising three tubular bands of a composite material, each of said bands being substantially rectangular in cross-section, a first rigid inner band being nested in a second band which is nested in a substantially seamless blast resistant third band so as to form a rectangular prism having six faces each of which has a thickness substantially equivalent to the sum of the thicknesses of at least two of the bands, each edge of the container being covered by at least one of said bands.

33. The blast resistant container of claim 32 wherein said composite material comprises at least one fibrous layer, said fibrous layer comprising at least one network of high strength fibers dispersed in a resin matrix, at least about 10 weight percent of said fibers being substantially continuous lengths of fiber that encircle the prism.

34. The blast resistant container of claim 33 wherein the third band is substantially seamless and comprises four rectangular surfaces in series which encircle the prism.

35. The blast resistant container of claim 34 wherein the bands deform during an explosion to increase the volume enclosed thereby.

* * * * *